US007250875B2

(12) United States Patent
Schnackenberg

(10) Patent No.: US 7,250,875 B2
(45) Date of Patent: Jul. 31, 2007

(54) TRAFFIC SIGNAL TRANSFER SWITCH

(75) Inventor: Paul Schnackenberg, Cumming, GA (US)

(73) Assignee: Geh-Tran Corporation, Roswell, GA (US)

( * ) Notice: Subject to any disclaimer, the term of this patent is extended or adjusted under 35 U.S.C. 154(b) by 208 days.

(21) Appl. No.: 11/157,753

(22) Filed: Jun. 21, 2005

(65) Prior Publication Data

US 2007/0008177 A1 Jan. 11, 2007

(51) Int. Cl.
*G08G 1/095* (2006.01)

(52) U.S. Cl. ..... 340/907; 340/908; 340/693.1; 340/693.2; 340/333; 361/90; 361/752; 361/800; 200/526; 200/276.1

(58) Field of Classification Search ..... 340/907, 340/908, 693.1, 693.2, 333; 361/90, 752, 361/800; 200/526, 276.1
See application file for complete search history.

(56) References Cited

U.S. PATENT DOCUMENTS

| | | | |
|---|---|---|---|
| 2,229,729 | A | 1/1941 | Emde |
| D130,944 | S | 12/1941 | Fogel, Jr. |
| D134,994 | S | 2/1943 | Fetter |
| D134,996 | S | 2/1943 | Kaminky |
| D135,528 | S | 4/1943 | Meyer |
| 2,865,017 | A | 12/1958 | Heikes |
| 2,997,691 | A | 8/1961 | Stoll |
| 3,041,420 | A | 6/1962 | Berry et al. |
| D201,244 | S | 6/1965 | Tateisi |
| D222,473 | S | 10/1971 | Zecca |
| 3,641,487 | A | 2/1972 | Rogers et al. |
| 4,013,849 | A | 3/1977 | Brown |
| 4,295,053 | A | 10/1981 | Kovatch et al. |
| 4,347,488 | A | 8/1982 | Mune et al. |
| 4,423,336 | A | 12/1983 | Iverson et al. |
| 4,504,807 | A | 3/1985 | Nar |
| 4,672,227 | A | 6/1987 | Lagree et al. |
| 4,716,496 | A | 12/1987 | Fritsch |
| 4,760,226 | A | 7/1988 | Fasano |
| D305,327 | S | 1/1990 | Newmark et al. |
| 5,081,367 | A | 1/1992 | Smith et al. |
| D332,088 | S | 12/1992 | Nimpoeno et al. |
| 5,208,584 | A | 5/1993 | Kaye et al. |
| 5,393,942 | A | 2/1995 | Reiner et al. |
| 5,397,868 | A | 3/1995 | Smith et al. |
| 5,486,664 | A | 1/1996 | Lamp et al. |
| 5,581,133 | A | 12/1996 | Smith et al. |
| 5,612,596 | A | 3/1997 | Wiese |
| 5,659,305 | A | 8/1997 | Rains et al. |
| D391,225 | S | 2/1998 | Wray |
| D391,233 | S | 2/1998 | Sitler |
| 5,898,389 | A | 4/1999 | Deese et al. |
| D416,232 | S | 11/1999 | Einck |
| 6,043,439 | A | 3/2000 | Crooks et al. |

(Continued)

*Primary Examiner*—Tai Nguyen
(74) *Attorney, Agent, or Firm*—Greenberg Traurig

(57) ABSTRACT

A transfer switch configured particularly for use with traffic signal controllers, to enable a traffic signal controller to be powered by a portable electrical generator, when utility line power is unavailable. A housing, configured to be mounted either on the surface of a traffic signal controller cabinet, or recessed into an opening of the cabinet, so as to be flush to the surface thereof, is provided. The housing is configured to be substantially weatherproof without requiring the use of gaskets.

19 Claims, 22 Drawing Sheets

U.S. PATENT DOCUMENTS

| | | | |
|---|---|---|---|
| 6,094,130 | A | 7/2000 | Uischner et al. |
| 6,121,897 | A | 9/2000 | Flegel |
| 6,163,449 | A | 12/2000 | Flegel |
| 6,227,890 | B1 | 5/2001 | Roper, Jr. et al. |
| 6,329,907 | B1 | 12/2001 | Uischner et al. |
| 6,365,990 | B2 | 4/2002 | Flegel |
| 6,504,268 | B1 | 1/2003 | Flegel |
| 6,534,735 | B1 | 3/2003 | Czarnecki |
| 6,570,269 | B2 | 5/2003 | McMillan et al. |
| 6,624,534 | B1 | 9/2003 | Flegel |

SECTION A-A

SECTION F-F

DETAIL J

SECTION E-E

Seal if needed
UNLOCK
LOCK
OFF
50
52
54
56
58
60
62
68
76
86
88
90
94
A
E
F
J

TRAFFIC SIGNAL TRANSFER SWITCH

BACKGROUND OF THE DISCLOSURE

1. Field of the Invention

The present invention relates in general to transfer switches configured for use with portable power generation devices, for powering traffic signals and the like, during periods of unavailability of utility line power.

2. Background Art

When the utility line power to an electrically powered and controlled traffic signal fails, it is imperative to arrange for an alternative power supply as quickly as possible, so that the traffic signal can resume operation. Otherwise, police officers typically must man the intersection where the non-functioning traffic signal is located, or else the motoring and pedestrian public is placed in danger from traffic through an uncontrolled intersection. Using police officers or other personnel not only is an inefficient use of manpower, but also can be dangerous to the individuals manning the intersection, as they typically must position themselves in the midst of traffic in order to be seen, to provide traffic control guidance.

Usually, the method of supplying auxiliary power comprises the placement of a small portable generator, usually powered by a gasoline internal combustion engine, next to the traffic signal control pedestal, and electrically connecting the power output connections of the generator to the power input connections of the traffic signal control pedestal.

However, simply breaking the hardwire connection between the traffic signal controller and the utility line, and making a hardwire connection directly between the generator output and the traffic signal controller input, is a time consuming, inefficient and inelegant solution. One cannot splice in the generator input without disconnecting the utility line, as that could result in the accidental driving of current back up the utility line, which could, in turn, result in utility equipment damage as well as grave personal injury.

Accordingly, it is known to connect a power transfer switch to the traffic signal controller, the line utility and to a portable generator output, so that the traffic signal controller may be safely switched back and forth between the line utility and the generator. In areas where the utility power may be interrupted not infrequently (such as in areas where weather is often severe), having a transfer switch more or less permanently mounted onto a traffic signal controller makes supplying power as simple as bringing a generator to the traffic signal controller.

Uischner et al., U.S. Pat. No. 6,094,130 discloses an emergency power station for traffic signals, in which a fuel supply, a self-starting generator, and an automatic transfer switch, which is connected to the general utility power supply of the traffic signal. The automatic transfer switch is configured to sense when the utility power fails. After a predetermined delay, the generator engine is started, to provide power to the signal. The unit is provided with red and green signal lights which indicate which power source (generator and utility, respectively) is being used at the moment. However, such a complete self-contained system would be both expensive to manufacture, and typically more equipment than is typically required, even if such an apparatus were to be actually commercially available.

Flegel, U.S. Pat. No. 6,121,897 discloses a transfer switch to be mounted onto an existing traffic signal control pedestal, and connected to a portable electrical power generator. A gasket seal is provided in the hinged front door to the housing, to prevent ingress of moisture, dirt, etc.; however, this gasket appears to extend around only the sides and top of the interior of the side-hinged cover, leaving a clear gap at the bottom of the cover-housing interface. The transfer switch uses a three-position rotary switch, to flip between "line" (connecting the utility to the signal controller), "off" (both circuits disconnected), and "generator" (connecting the generator to the signal controller). While this manual transfer switch construction is considerably simpler than the fully automated station of the Uischner et al., U.S. Pat. No. 6,094,130 station, it lacks protection for the circuits.

It would be desirable to provide a simplified, basic transfer switch apparatus, for use with a traffic signal controller, which is provided with provisions for protection of the circuits.

It would also be desirable to provide a transfer switch apparatus for use with a traffic signal controller, which is provided with an indicator, to show when power to a utility line has been restored, so that upon remote visual inspection of the apparatus, one can see that it is possible to shut off a generator, and restore connection to utility power.

These and other desirable characteristics of the present invention will become apparent in view of the present specification, including claims, and drawings.

SUMMARY OF THE INVENTION

The present invention comprises a transfer switch, operably configured to be connected to a portable electrical power generator, a traffic signal controller and a utility electrical power source, for enabling repeated switching between the portable electrical power generator and the utility electrical power source to provide electrical power to the traffic signal controller.

The traffic signal transfer switch comprises a housing, having a cavity therewithin and at least a first opening thereto. Transfer switch circuitry is disposed in the cavity in the housing.

The transfer switch circuitry includes a power inlet for receiving the power outlet connector of a portable electrical power generator; a switching mechanism for reciprocably switching between at least a first position, enabling power to be supplied from the portable electrical power generator to the traffic signal controller, and a second position, enabling power to be supplied from the utility electrical power source to the traffic signal controller; a first electrical input connection, associated with the switching mechanism, and operably configured to be connected to a utility line power supply; a second electrical input connection, associated with the switching mechanism, and operably connected to the power inlet; and at least one electrical output connection, associated with the switching mechanism, and operably configured to be connected to a traffic signal controller.

A lockout device is operably associated with the switching mechanism, for preventing the switching mechanism from being positioned so as to enable power from both the portable electrical power generator and the utility electrical power source from being supplied to the traffic signal controller.

At least one pivotable cover is operably associated with the housing, so as to protect the cavity from intrusion by undesired materials.

In an embodiment of the invention, the housing is operably configured to be mounted to an exterior surface of a cabinet of a traffic signal controller.

The traffic signal transfer switch further comprises a face plate, disposed in the at least first opening, for enclosing transfer switch circuitry within the housing. In this embodiment, the housing may comprise opposed side walls having front edges, bottom edges, and top edges and a rear wall having a top edge; and a top having downwardly extending flanges covering the top edges of the side walls and rear wall, and a further downwardly extending flange extending across a front opening of the housing. In this embodiment, the at least one pivotable cover may comprise a bottom cover, pivotably mounted to the opposed side walls between at least an open position and a closed position, and having a bottom panel and two side flanges extending upwardly when the bottom cover is in its closed position, the two side flanges being disposed to the inside of the bottom edges of the side walls, when the bottom cover is in its closed position; and a front cover, pivotably mounted to the opposed side walls between at least an open position and a closed position, the front cover further having a front panel, two side flanges and a bottom flange, which extend rearwardly from the front panel when the front panel is in its closed position, the side flanges covering the front edges of the opposed side walls when the front cover is in its closed position, and the bottom flange covering a front edge of the bottom cover, when the front cover and the bottom cover are in their respective closed positions.

The switching mechanism may comprise at least a first circuit breaker electrically connected between the first electrical input connection and the at least one electrical output connection; and at least a second circuit breaker electrically connected between the second electrical input connection and the at least one electrical output connection.

The traffic signal transfer switch may further comprise an indicator, operably connected to the switching mechanism, and operably configured to provide an indication when utility line power is available. The indicator may be operably connected to the at least first circuit breaker, to indicate when utility line power is available. The indicator may be a light.

In an alternative embodiment of the invention, the housing may be operably configured to be mounted within a suitably configured recess in a cabinet for a traffic signal controller. In this embodiment, the housing may comprise a top wall, a bottom wall, two opposed side walls and a rear wall, and a front opening. The housing may further comprise at least one mounting flange emanating away from at least one of the top wall, bottom wall, two opposed side walls, and operably configured for attachment to a mounting frame, which, in turn, is operably configured for attachment to an outer wall of a traffic signal controller. The housing may further comprise a plurality of run-off channels extending along the top wall, and two opposed side walls, between the front opening and the at least one mounting flange. Each of the run-off channels preferably has a J-shaped cross-sectional configuration. In this embodiment, the at least one pivotable cover may comprise a front cover panel, hingedly mounted to the at least one mounting flange, the front cover panel being pivotable between at least a first, upward open position, and a second, downward closed position; and a plurality of side flanges emanating rearwardly from at least top and side edges of the front cover panel, when the front cover panel is in its second, downward closed position. The side flanges are preferably configured to extend over the run-off channels, when the front cover panel is in its closed position.

The switching mechanism may further comprise two first circuit breakers electrically connected between the first electrical input connection and the at least one electrical output connection; and two second circuit breakers electrically connected between the second electrical input connection and the at least one electrical output connection.

The transfer switch circuitry may alternatively further comprise a first electrical neutral connection, associated with the switching mechanism, and operably configured to be connected to a neutral connection of a utility line power supply; a second electrical neutral connection, associated with the switching mechanism, and operably configured to be connected to a neutral connection of the power inlet; and a third electrical neutral connection, associated with the switching mechanism and operably configured to be connected to a neutral electrical connection of a traffic signal controller. In this embodiment, the switching mechanism may further comprise a first neutral circuit breaker, connected to the first electrical neutral connection and the third electrical neutral connection; and a second neutral circuit breaker, connected to the second electrical neutral connection and the third electrical neutral connection. The invention also comprises the housings for a traffic signal transfer switch, as described herein.

DETAILED DESCRIPTION OF THE INVENTION

Figure 1:
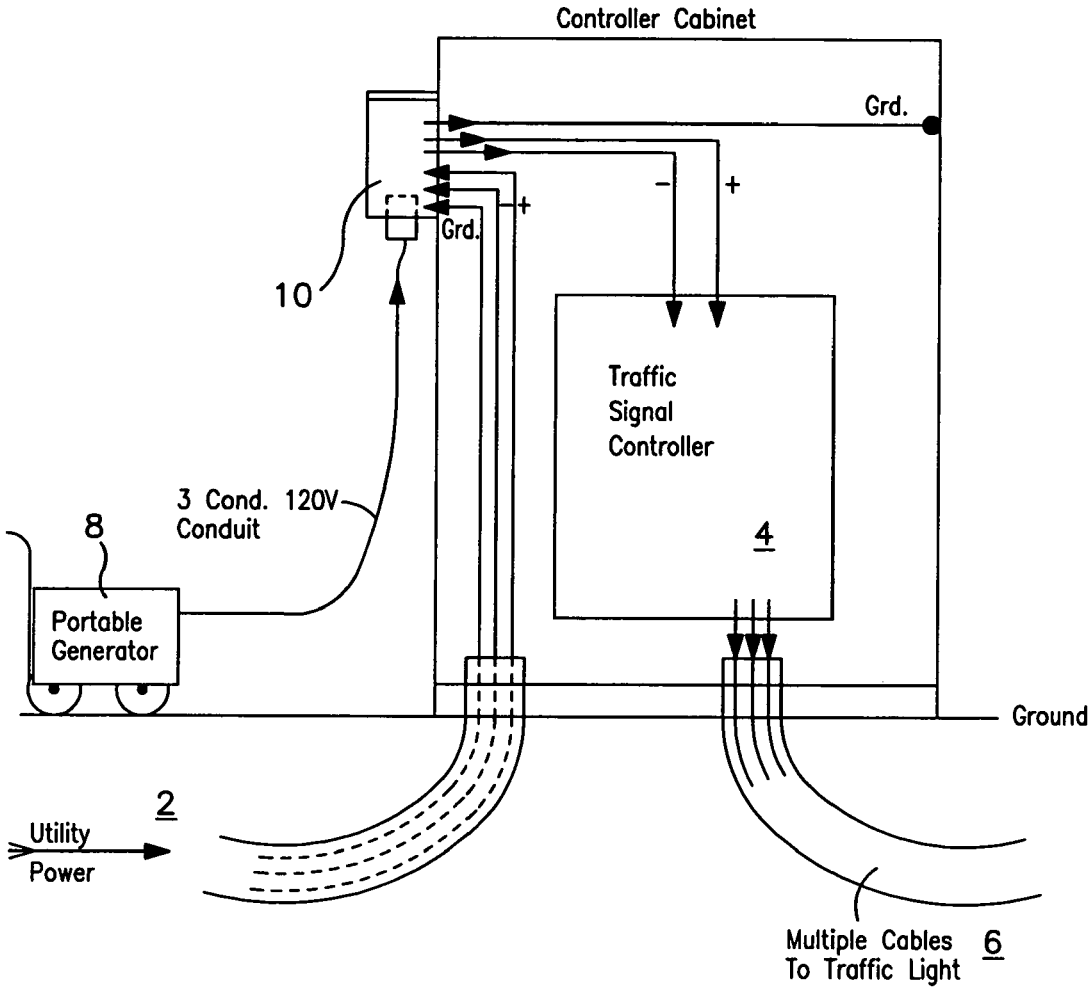
FIG. 1 is a simplified schematic illustration of the electrical connections between utility power, a traffic signal controller, a portable power generator and traffic signal transfer switch.

While this invention is susceptible of embodiment in many different forms, there is shown in the drawings and will herein be described in detail, a preferred embodiment with the understanding that the present disclosure should be considered as an exemplification of the principles of the invention and is not intended to limit the invention to the embodiment so illustrated.

FIG. 1 is a simplified schematic illustration of the electrical connections between utility power 2, a traffic signal controller 4 connected to one or more traffic signals 6 (not shown), a portable power generator 8 and a traffic signal transfer switch 10, in accordance with the present invention.

The present invention contemplates three different transfer switch circuitry configurations, and two different housing configurations. The three different circuitry configurations are: 1) single pole (FIG. 2); 2) double pole (FIG. 3); and 3) single pole with switched neutral (FIG. 4). The reasons for the different configurations are as follows. Most, but not all, traffic signal controllers at the present time, operate on 120 VAC, so a single pole transfer switch is adequate for most applications. Some municipalities and other applications may have a 120/240 VAC system, so a two-pole device is required. With respect to the single-pole, switched neutral transfer switch, it is believed by some that potentially dangerous "stray" currents may run through the neutral wire, during operation of the portable generator, so some municipal (or other) regulations require that the neutral wires be switched as well.

Figure 2:
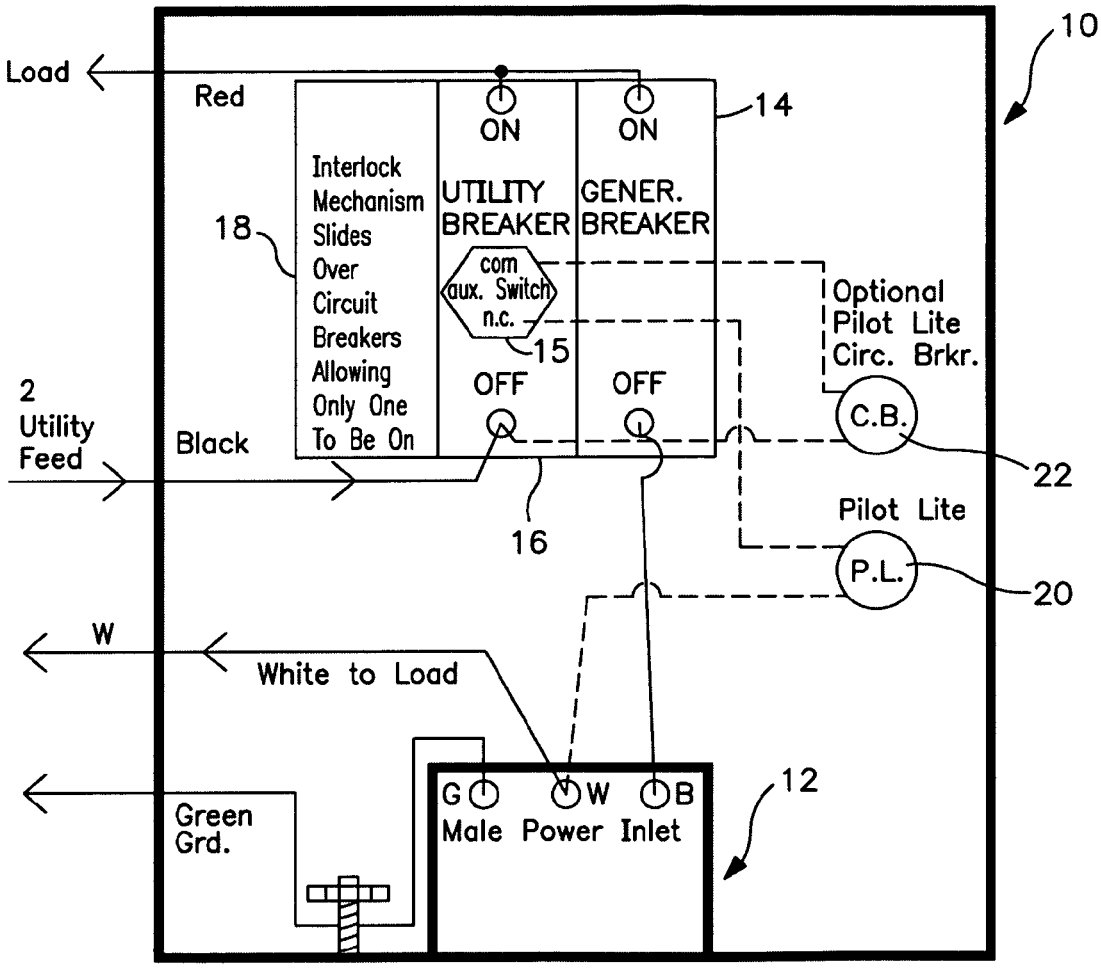
FIG. 2 is a schematic illustration of transfer switch circuitry according to an embodiment of the invention.

In the basic version of the transfer switch apparatus 2, see FIG. 2, traffic signal transfer switch 10 is electrically connected to the utility power feed, to ground, and to the load (the traffic signal controller). As would be readily perceived by one of ordinary skill in the art, having the present disclosure before them, this would be accomplished by gaining access to the utility power feed 2 (FIG. 1), and to the power inputs to the traffic signal controller 4, via a suitable access aperture either already provided (e.g., by conventional knock-outs), or cut into the side of the housing of the traffic signal controller.

Traffic signal transfer switch 10 will be provided with a weatherproof housing (as discussed in further detail hereinafter), in which is contained a male power inlet 12, having a suitable socket for receiving the power outlet cord of a portable generator 8 (FIG. 1). Transfer switch 10 also includes two break-before-make circuit breakers 14, 16 for the generator circuit and the utility power circuit, respectively. By way of example, and not to limit the invention thereto, the circuit breakers may be of the type manufactured by Carling Technologies, C-Series Circuit Breakers (without microswitch for breaker 14 and with microswitch for breaker 16). Representative model numbers for such breakers could be CA1-BO-24-620-121-KG, CA1-BO-24-630-121-KG, and CA1-BO-24-650-121-KG (for 20, 30 and 50 amp single pole breakers without auxiliary microswitches); CA2-BO-24-620-121-CG, CA2-BO-24-630-121-CG, and CA2-BO24-650-121-CG (for 20, 30 and 50 amp 2 pole breakers without auxiliary microswitches), CA1-B2-24-620-121-KG, CA1-B2-24-630-121-KG and CA1-B2-24-650-121-KG (for 20, 30 and 50 amp single pole breakers with microswitches), and CA2-B2-24-620-121-CG, CA2-B2-24-630-121-CG and CA2-B2-24-650-121-CG (for 20, 30 and 50 amp 2 pole breakers with auxiliary microswitches). An interlock (or more precisely, lockout) mechanism 18 is provided, which is configured (as shown hereinbelow) to slide back and forth over the switch handles of the respective circuit breakers, to ensure that at any given time, only one of the circuit breaker switch handles can be in its "ON" position.

In addition, transfer switch 10 is provided with a "pilot light" 20 (and associated pilot light circuit breaker 22), which is-connected to the utility power circuit in such a manner that whether the switch handle of circuit breaker 16 is in its "OFF" position, if there is a voltage of a minimum required value across the utility power circuit breaker 16, then pilot light 20 will be lit, indicating that the utility power circuit has been restored and is available, so that an operator, such as a police officer, or municipal or county employee can turn off the generator, shift the lockout device, and flip the utility power circuit breaker to "ON", to restore operation of the traffic signal controller to utility power. The generator 8 can then be disconnected from the transfer switch 10, and removed. Specifically, breaker 16 is provided with an auxiliary microswitch (used elsewhere for powering a light for a remote panel to indicate position of the breaker, depending upon how the microswitch is wired), in the form of a single-pole, double-throw (SPDT) switch 15 built into the circuit breaker, and operated in slave fashion by the main circuit breaker handle. When the utility circuit breaker 16 is flipped to "ON", then microswitch 15 opens, so that current to pilot light 20 is cut off. One of ordinary skill in the art of electrical circuit design may substitute circuit breakers from other manufacturers, which also provide optional microswitches, for those described hereinabove, without departing from the scope of the invention.

Figure 3:
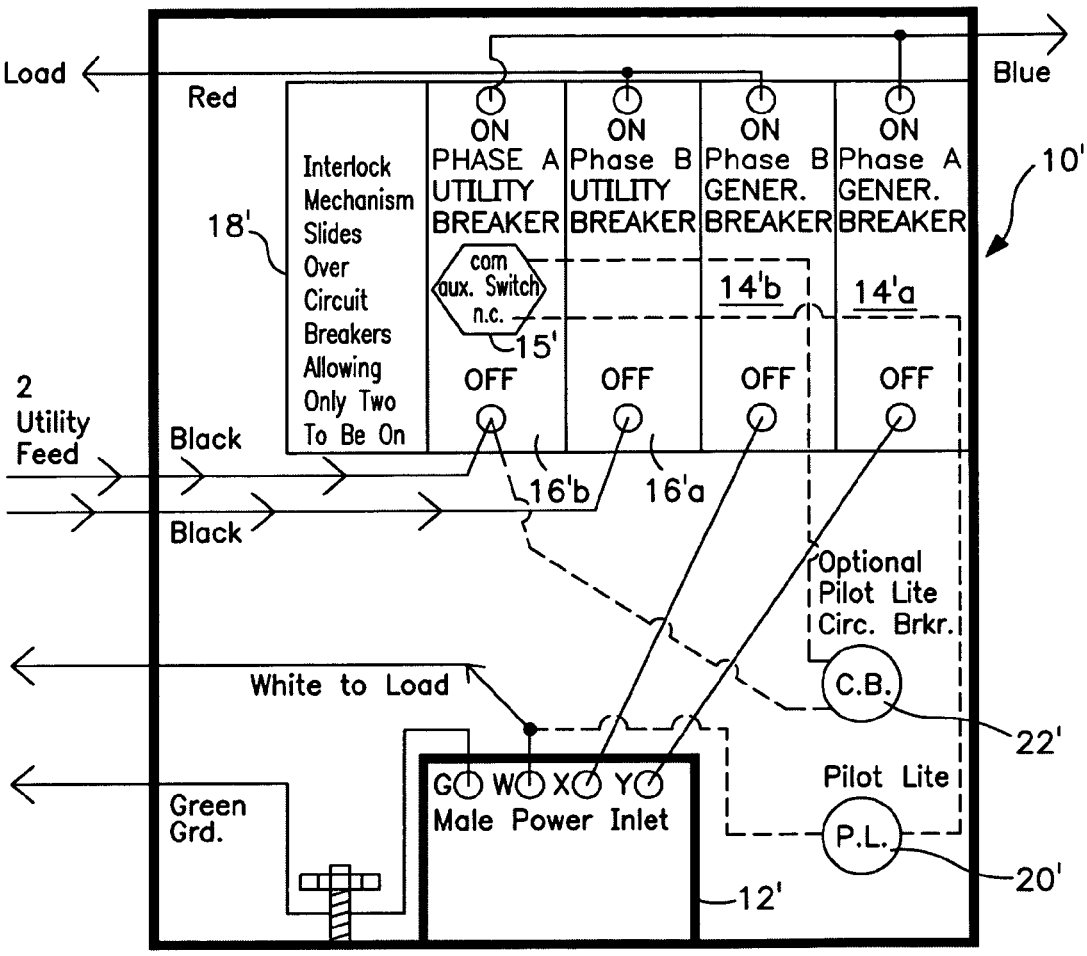
FIG. 3 is a schematic illustration of transfer switch circuitry according to another embodiment of the invention.
Figure 4:
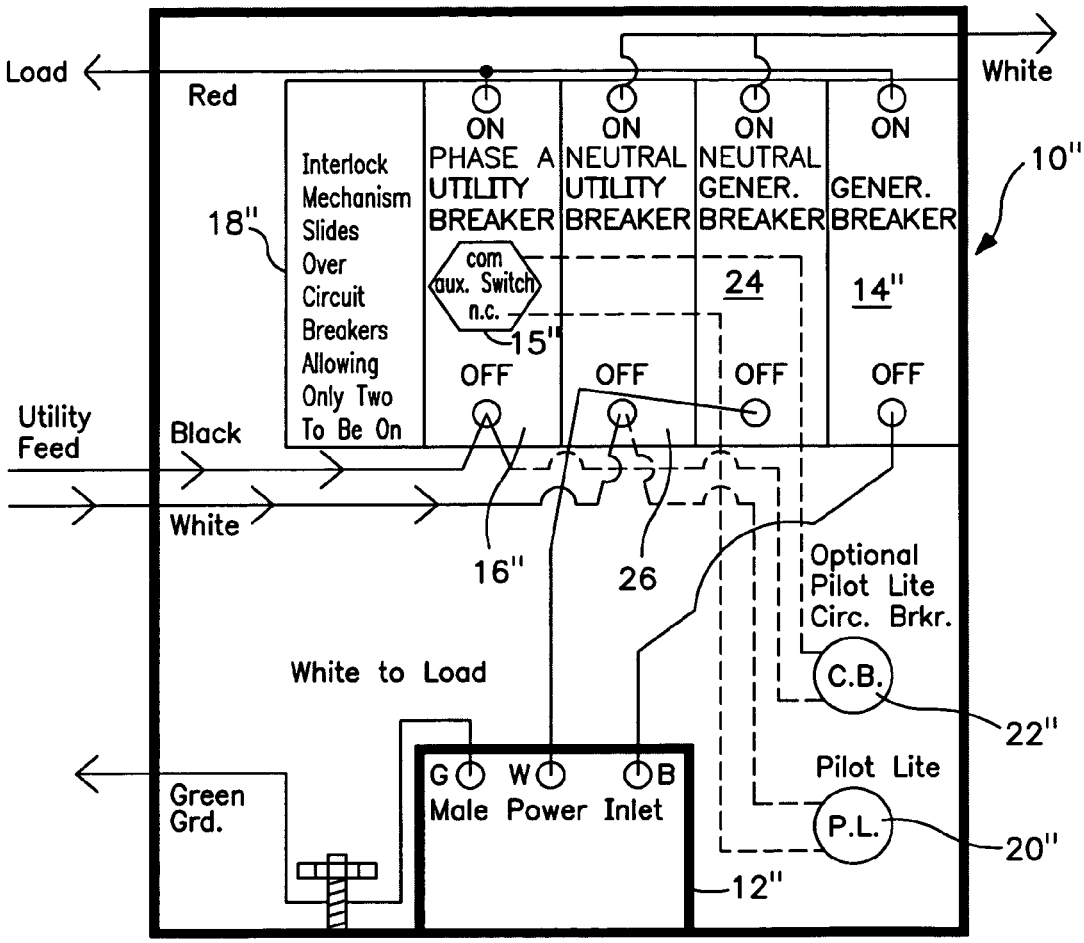
FIG. 4 is a schematic illustration of transfer switch circuitry according to another embodiment of the invention.

FIG. 3 is a schematic illustration of the circuitry of a two-pole traffic signal transfer switch. To the extent that two-pole traffic signal transfer switch 10' is provided with components having identical, similar or analogous structures and/or functions as that of single pole transfer switch 10, like reference numerals, augmented by a prime (') and, as necessary, letters, will be employed. The circuitry of transfer switch 10' differs from that of transfer switch 10 primarily in that two breakers (14'*a*, 14'*b* and 16'*a*, 16'*b*) are provided for each of the generator and utility power circuits, mostly for enabling larger voltage loads to be supplied, e.g., up to 250 volts for the two-breaker transfer switch 10', versus up to 125 volts for the single pole transfer switch 10. Alternatively, breakers 14'*a*, 14'*b* and 16'*a*, 16'*b* may be formed by two two-pole breakers, wherein one side of one of the two-pole breakers is provided with a microswitch, such as may be commercially obtained from Carling Technologies, as mentioned above. Interlock mechanism 18' will be provided so as to cover the (usually interconnected) switch handles of either circuit breakers 14'*a* and 14'*b*, or 16'*a* and 16'*b*. Pilot light 20' and associated circuit breaker 22' will be connected to one or the other of circuit breakers 16'*a*, 16'*b* (having a microswitch 15', again, to indicate when there is power available in the utility power circuit, when the utility power circuit breakers are in their respective "OFF" positions.

FIG. 4 is a schematic illustration of the circuitry of a single-pole switched neutral traffic signal transfer switch. To the extent that two-pole traffic signal transfer switch 10" is provided with components having identical, similar or analogous structures and/or functions as that of single pole transfer switch 10, like reference numerals, augmented by a double prime (') and, as necessary, letters, will be employed. Transfer switch 10" differs from the single-pole transfer switch 10, in that in addition to generator circuit breaker 14" and utility circuit breaker 16", neutral generator breaker 24 and neutral utility breaker 26 are provided.

Figure 5:
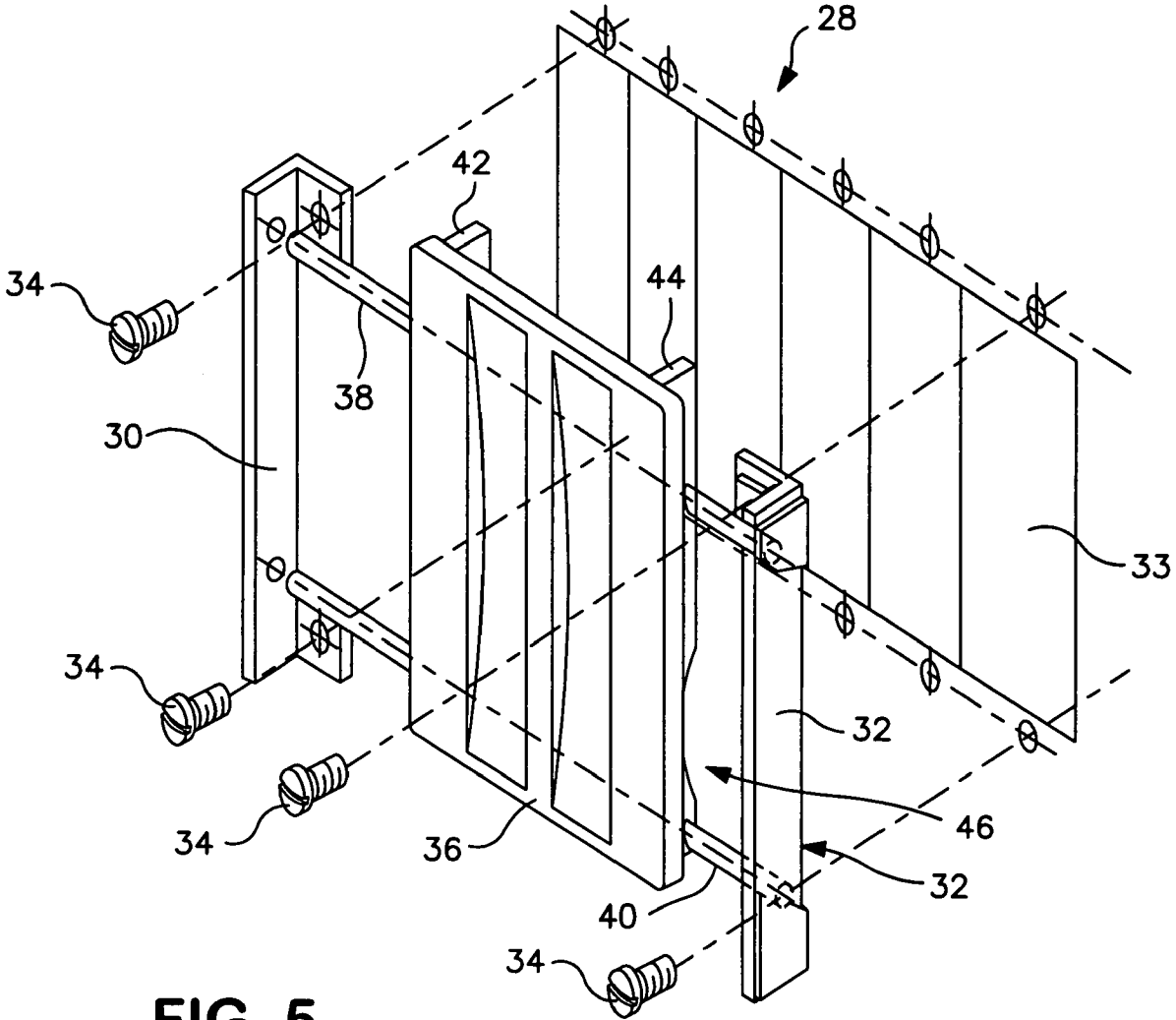
FIG. 5 is an exploded perspective view of a lockout device for use with the transfer switches of the present invention.
Figure 7:
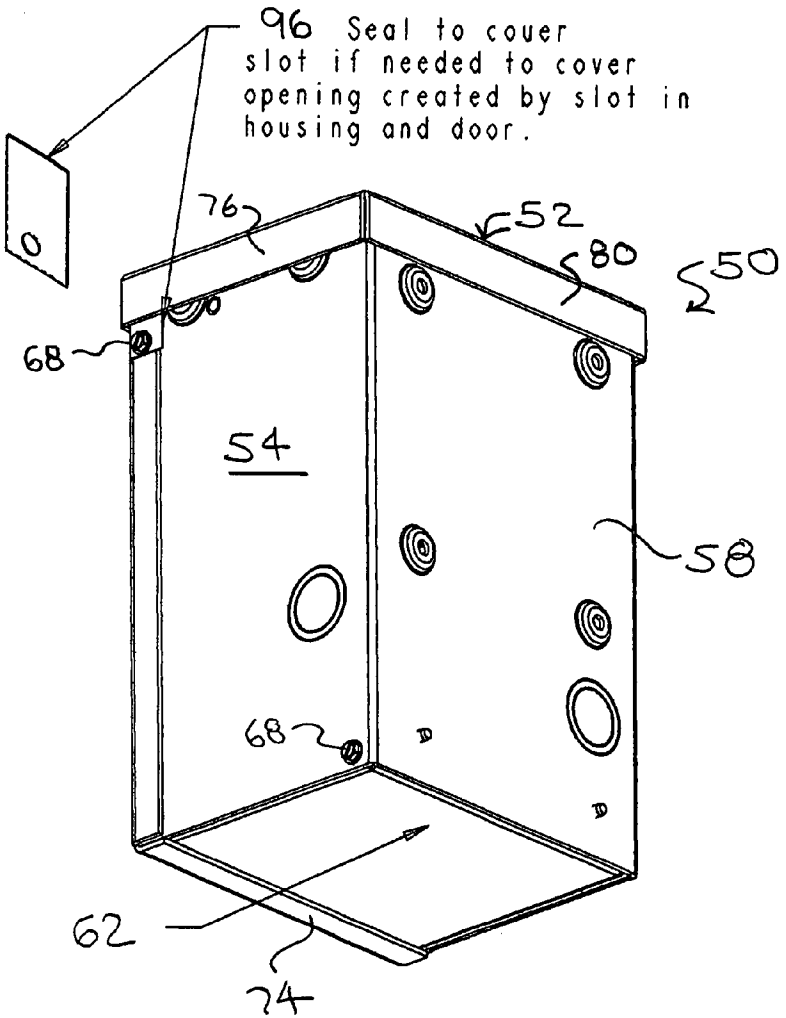
FIG. 7 is a bottom, rear, perspective view of the surface-mounted transfer switch, in a closed configuration.
Figure 6:
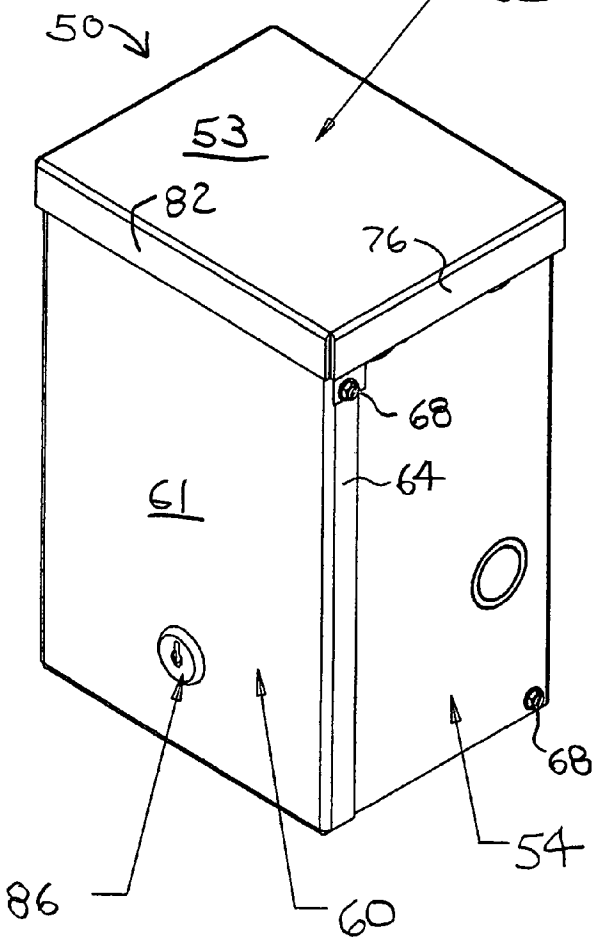
FIG. 6 is a top, front, perspective view of a surface-mounted traffic signal transfer switch according to a preferred embodiment of the invention, in a closed orientation.
Figure 9:
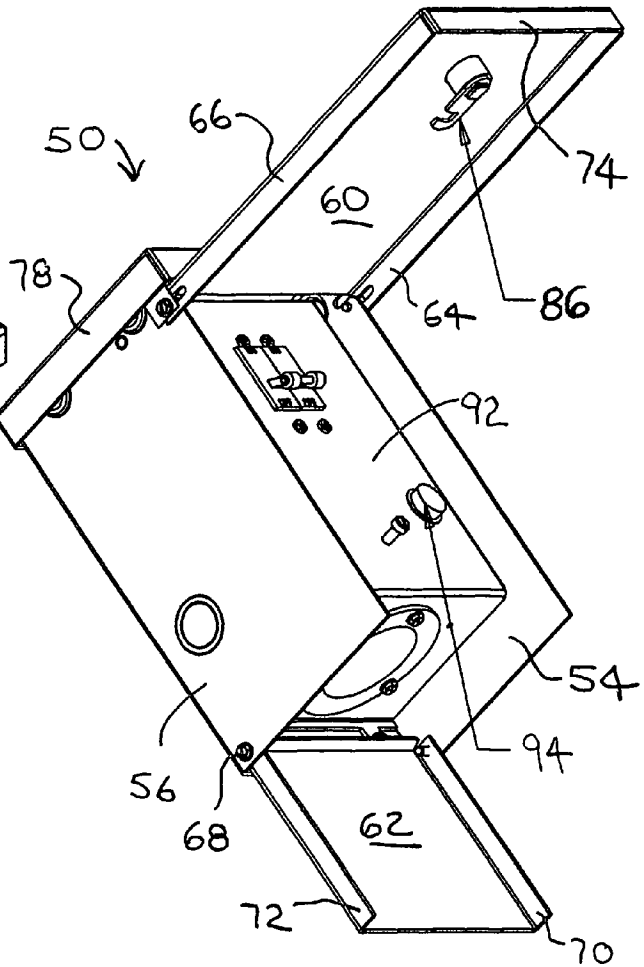
FIG. 9 is a bottom, front, perspective view of the surface-mounted traffic signal transfer switch, in an open configuration.
Figure 8:
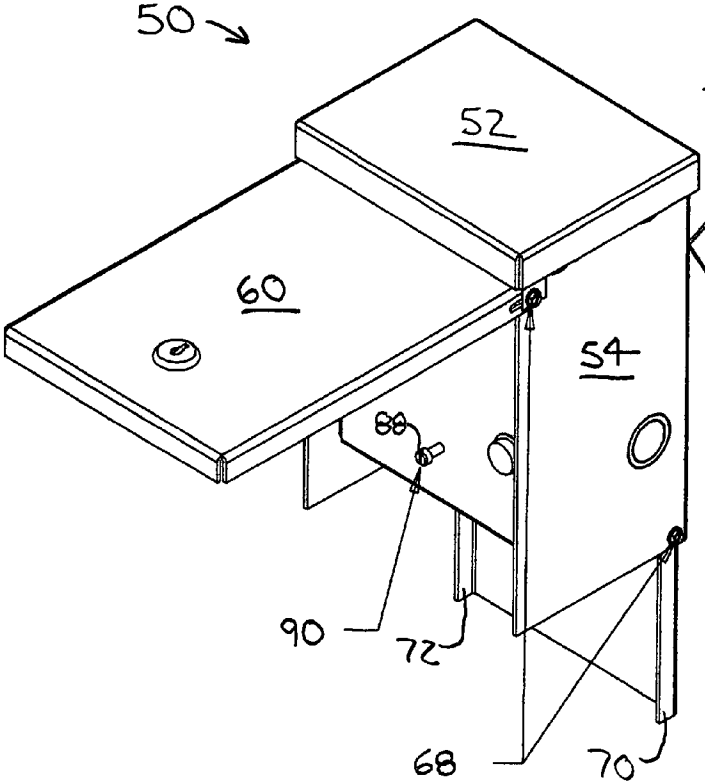
FIG. 8 is a top, front, perspective view of the surface-mounted traffic signal transfer switch, in an open configuration.

FIG. 5 is a perspective exploded view of an interlock (lockout) device 28, which may be employed with any of transfer switches 10, 10' or 10". Lockout device 28, which may be of the type commercially available from Carlingswitch, Inc. of Plainville, Conn., incorporates two end caps 30, 32, which are attached (e.g., via machine screws 34) preferably to the front surface 33 of the inner faceplate of the transfer switch (details of the transfer switch housings to be discussed hereinafter), or to the faces of the circuit breakers themselves. Handle lockout 36 is configured to be slidingly inserted onto pins 38, 40. Typical assembly would be to mount one end cap 30 to the transfer switch, then insert pins 38, 40 into cap 30. Lockout 36 is then slid onto pins 38, 40. Finally, remaining end cap 32 is fitted to the free ends of pins 38, 40, and fastened to the transfer switch face. Lockout 36 includes two webs 42, 44, extending normal to the faceplate, each of which has a notch 46, configured for providing clearance for accommodating the switch handle(s) of the generator or utility circuit breakers, when in their "OFF" (typically down) positions. The foregoing description represents one particular structure for a lockout device for side-by-side breaker switches. Other lockout structures may be employed, without departing from the scope of the present invention.

FIGS. 6-9 illustrate views of the outside of a housing for a transfer switch unit, according to the present invention. In a preferred embodiment of the invention, housing 50 includes top 52 (with top face 53), sides 54 and 56, back 58, hinged front 60 (with front surface 61) and hinged bottom 62. Preferably, housing 50 may be fabricated sheet metal (e.g., rust-resistant steel or aluminum) which has been suitably cut or stamped, bent and molded, as desired. In a preferred embodiment, top 52 may be formed from a separate piece of material, apart from sides 54 and 56, and back 58, which may be formed from a single piece of metal, and suitably attached thereto, by any suitable method, such as welding.

Front 60 includes two side flanges 64, 66 which cover the front edges of sides 54, 56, when front 60 is in its down/closed position. Front 60 is pivotably connected to sides 54, 56, via, e.g., rivets 68 passing through side flanges 64, 66, and sides 54, 56, respectively. Bottom 62 includes two side flanges 70, 72, which fit inside the bottom edges of sides 54, 56, when bottom 62 is in the up/closed position. Front 60 does not simply pivot about rivets 68. Rather, rivets 68 pass through elongated slots (see FIGS. 19, 20). Movement of front 60 first involves unlocking lock 86 (discussed below), then sliding front 60 downwardly relative to sides 54, 56, and then pivoting front 60 upwardly relative to housing 50. Bottom 62 is pivotably attached to sides 54, 56 also by suitable fasteners, e.g., rivets 68. Front 60 also includes a bottom flange 74, which covers the leading edge of bottom 62, when bottom 62 is in its up/closed position. Top 52 includes downwardly extending flanges 76, 78, 80 and 82, which cover (or shield) the upper edges of sides 54 and 56, back 58 and front 60. By providing coverage for otherwise exposed edges, as described hereinabove, housing 50 is constructed to be substantially rainproof, for ordinary weather conditions that may be encountered. If necessary, where rivets 68 are used to pivotably mount front 60, to cover slots 102, 104, additional protection in the form of rectangular seals 96 (preferably fabricated from a suitable plastic material, such as polycarbonate film) may be provided.

Housing 50 includes for security purposes key-operated lock 84, which includes hook member 86, which engages behind flange 88 of bolt 90, in faceplate 92. The breaker switches shown positioned in faceplate 92 (e.g., FIG. 9) are shown solely by way of example, and not intended to limit the scope of the present invention. Faceplate 92 may also include a pilot light 94 (as described above), which may be physically positioned at any suitable location on faceplate 92. Alternatively, pilot light 94 may be positioned on sides 54 or 56, or in top 52 (if suitable gasketing is provided to create a weatherproof interface between the pilot light and the surface of the respective side or top).

Figures 10, 11, 12, 13, 14:
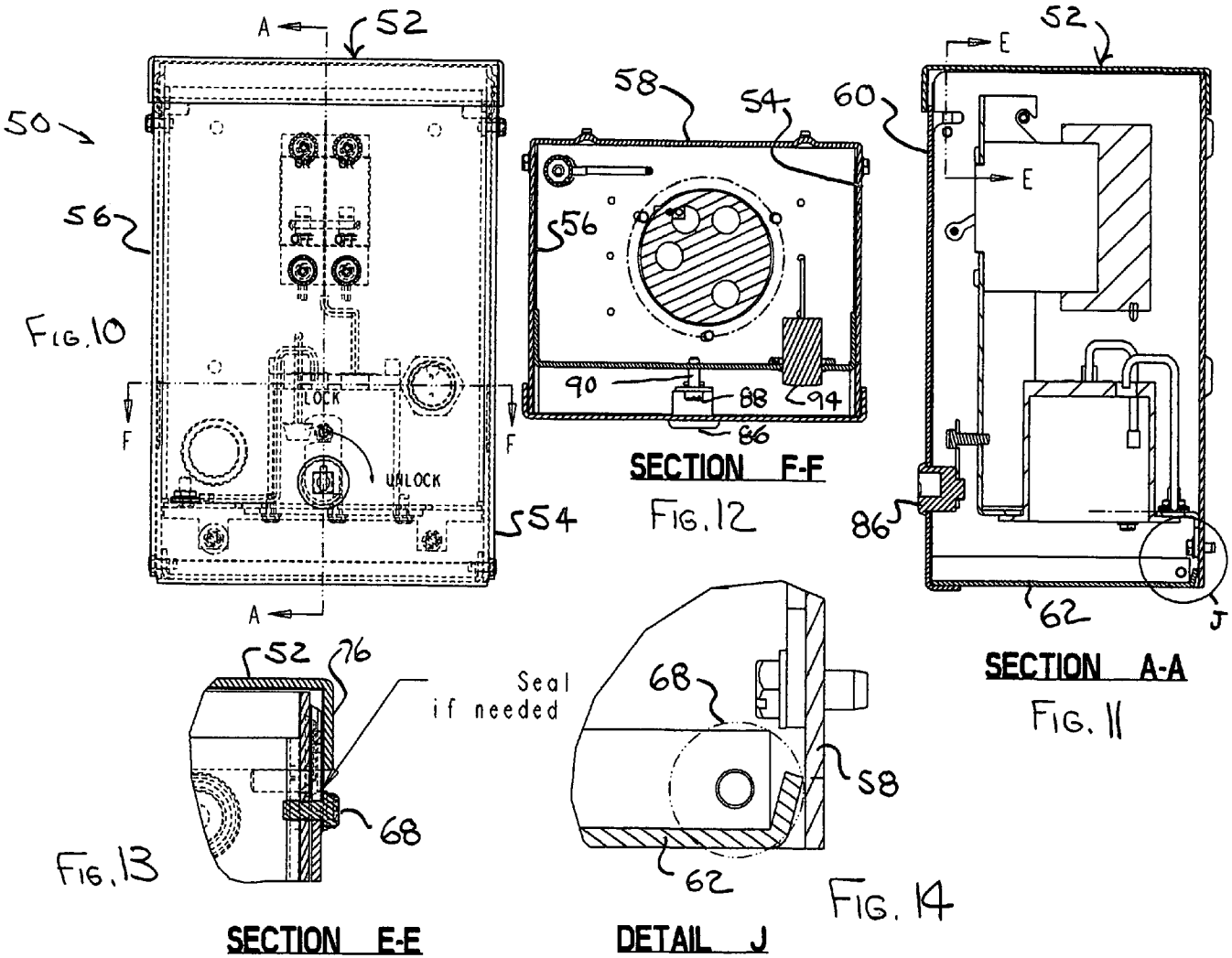
FIG. 10 is a front elevation of the surface-mounted traffic signal transfer switch, in closed configuration.
FIG. 11 is a side elevation, in section, taken along line A-A of FIG. 10.
FIG. 12 is a top elevation, in section, taken along line F-F of FIG. 10.
FIG. 13 is a fragmentary front elevation, in section, taken along line E-E of FIG. 11.
FIG. 14 is an enlarged detail of the housing of the surface-mounted traffic signal transfer switch, of detail J, shown circled in FIG. 11.

FIG. 10 is a front elevation of the surface-mounted traffic signal transfer switch, in closed configuration. FIG. 11 is a side elevation, in section, taken along line A-A of FIG. 10. FIG. 12 is a top elevation, in section, taken along line F-F of FIG. 10. FIG. 13 is a fragmentary front elevation, in section, taken along line E-E of FIG. 11. FIG. 14 is an enlarged detail of the housing of the surface-mounted traffic signal transfer switch, of detail J, shown circled in FIG. 11. Any internal structures illustrated therein are shown strictly by way of example, and the present invention is not intended to be limited to any specific combination or positioning of the internal electrical components shown in these figures.

Figure 15:
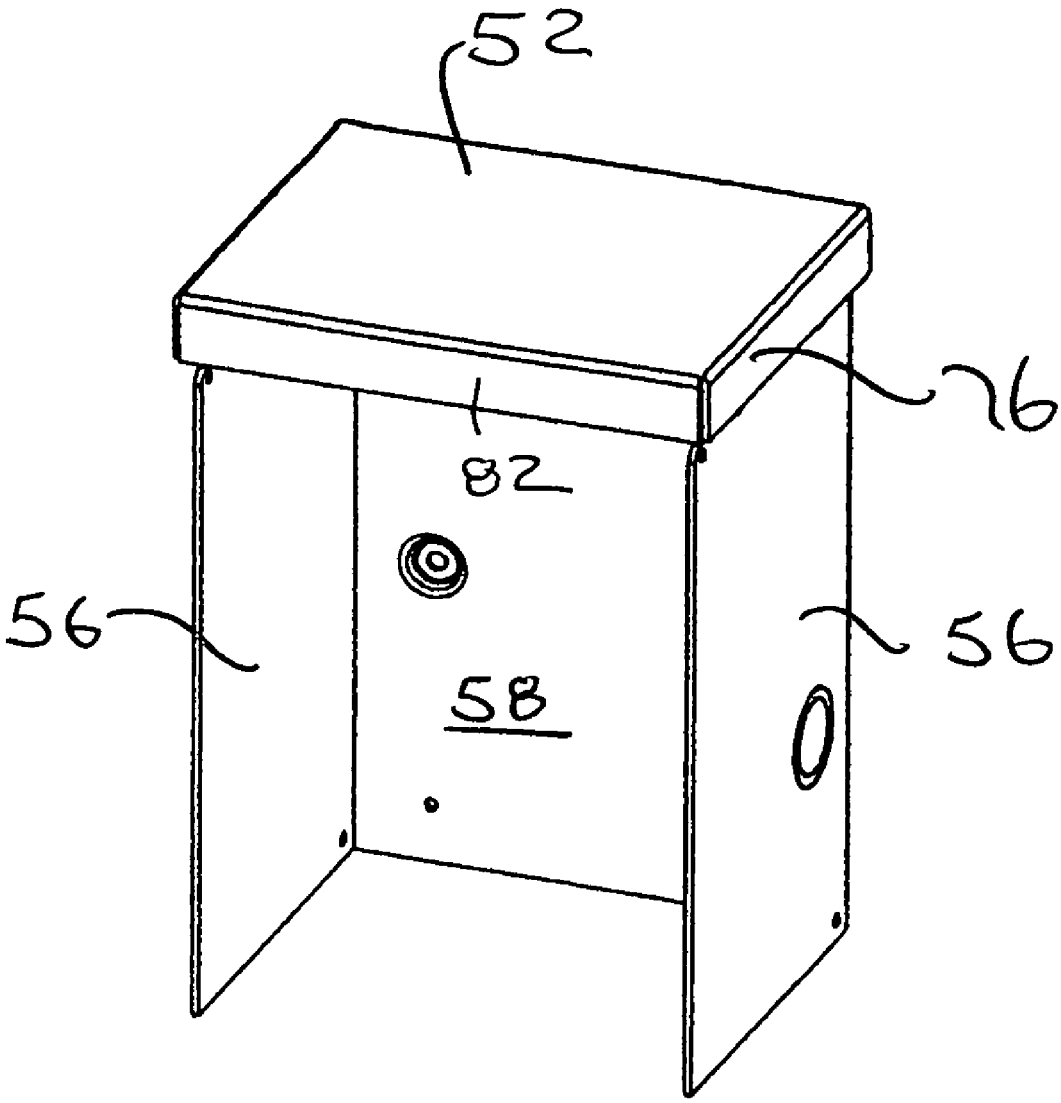
FIG. 15 is a top, front, perspective view of the top, sides and back portions of the housing for the surface-mounted traffic signal transfer switch.
Figure 16:
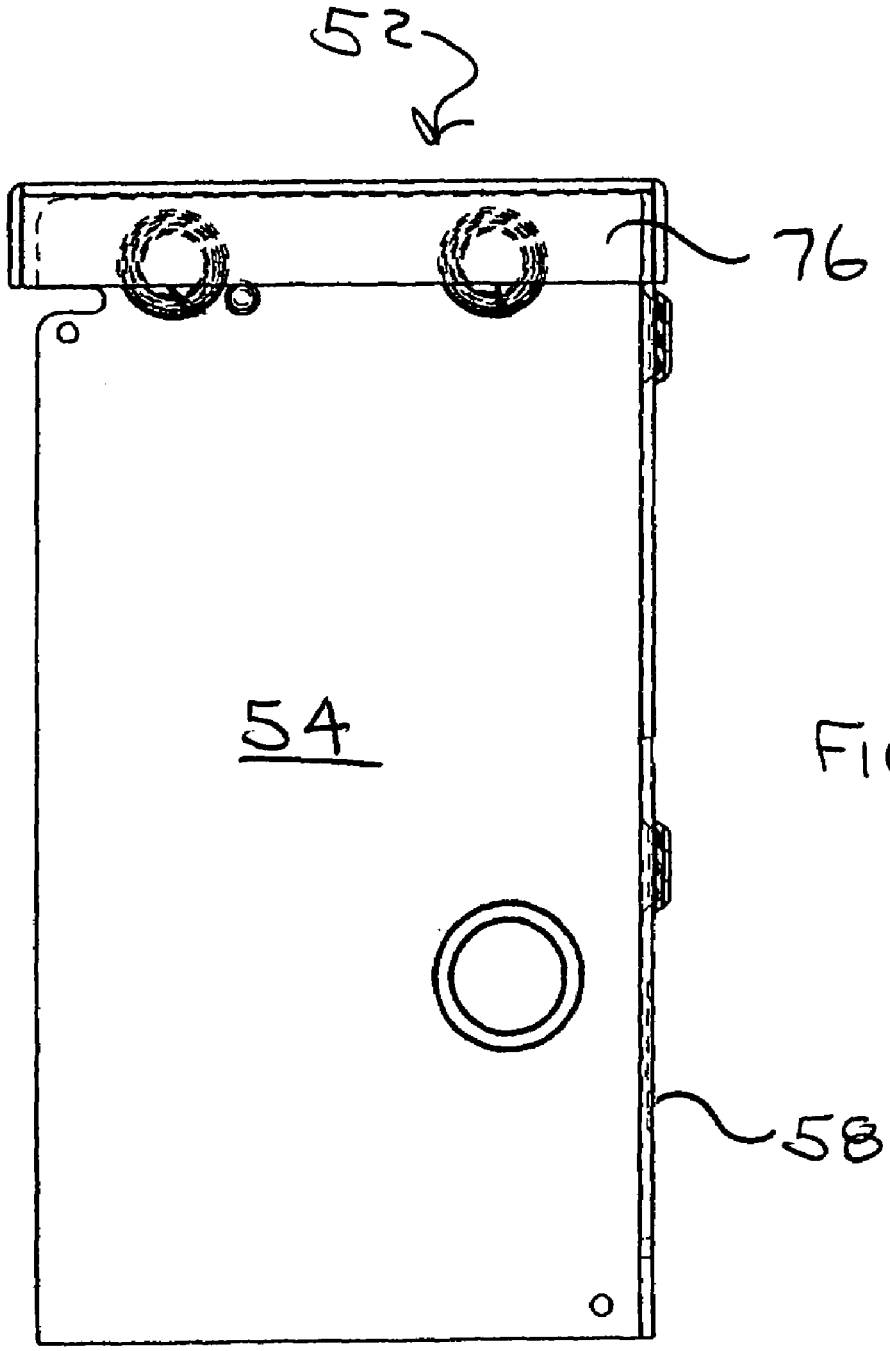
FIG. 16 is a side elevation of the top, side and back portions of the housing for the surface-mounted traffic signal transfer switch.

FIG. 15 is a top, front, perspective view of the top 52, sides 56 and 56 and back 58 portions of the housing for the surface-mounted traffic signal transfer switch. FIG. 16 is a side elevation thereof.

Figure 18:
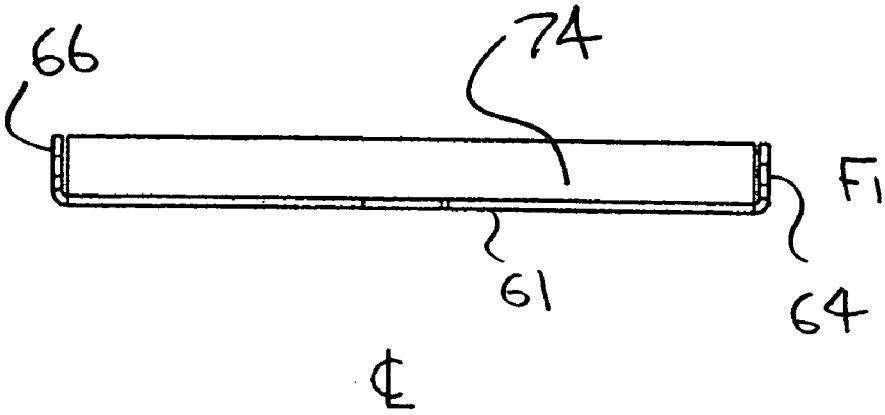
FIG. 18 is a top plan view of the front cover of the housing for the surface-mounted traffic signal transfer switch.
Figure 17:
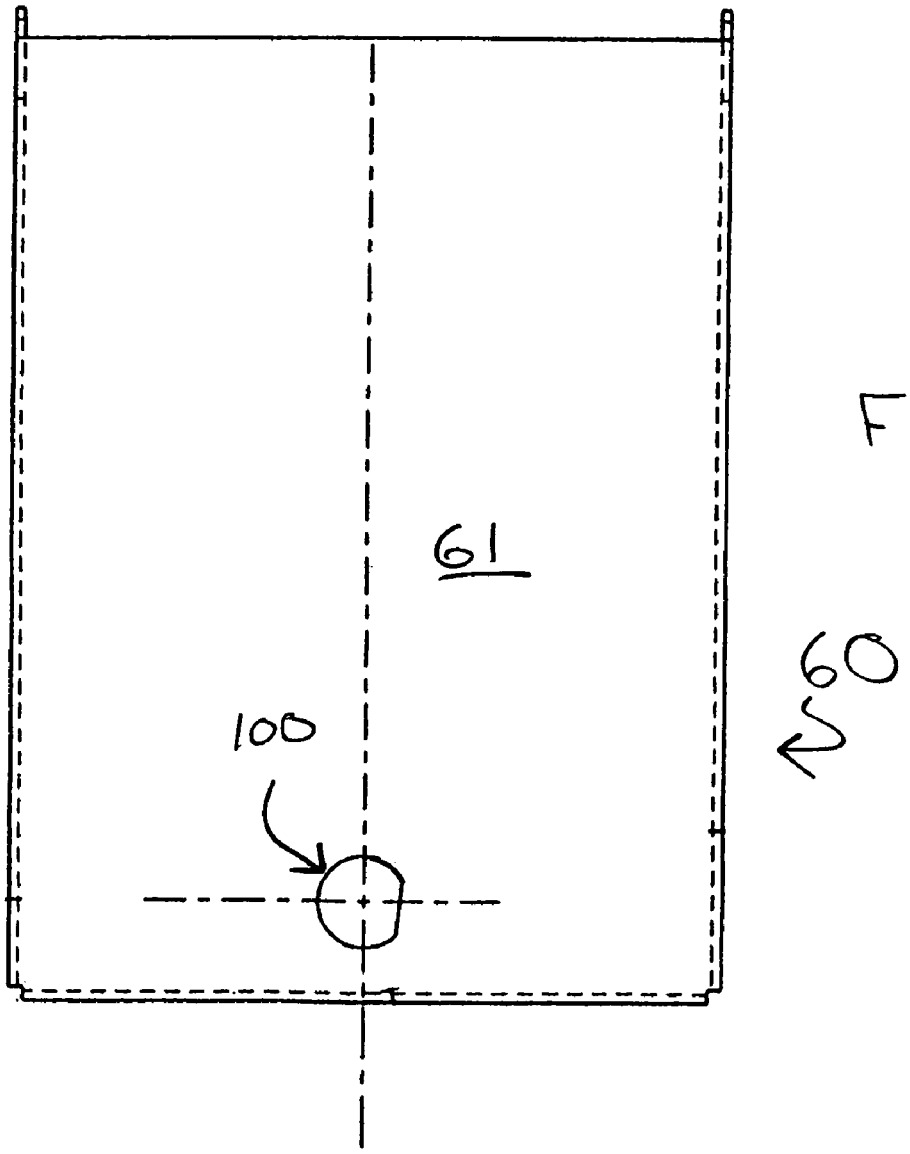
FIG. 17 is a front elevation of the front cover for the housing for the surface-mounted traffic signal transfer switch.
Figure 19:
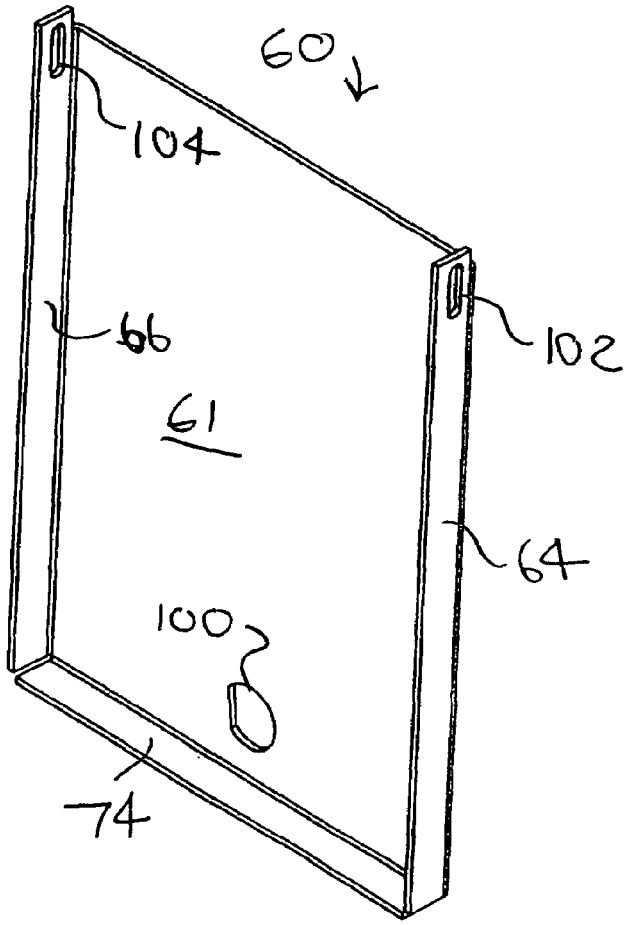
FIG. 19 is an inside perspective view of the front cover of the housing for the surface-mounted traffic signal transfer switch.
Figure 20:
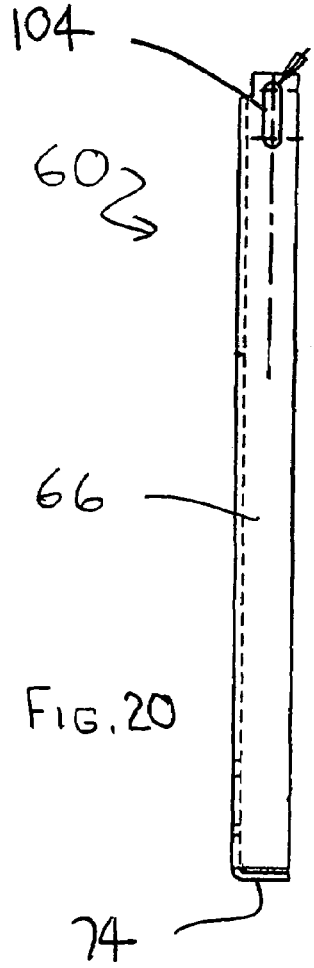
FIG. 20 is a side elevation of the front cover of the housing for the surface-mounted traffic signal transfer switch.

FIG. 17 is a front elevation of the front cover for the housing for the surface-mounted traffic signal transfer switch, showing, in particular, opening 100 for receiving lock 86. FIG. 18 is a top plan view thereof. FIG. 19 is an inside perspective view thereof, showing slots 102, 104 (through which rivets 68 pass), which permit cover 61 to slide vertically, as well as pivot, relative to the sides, top and back of the housing 50. FIG. 20 is a side elevation thereof.

Figure 21:
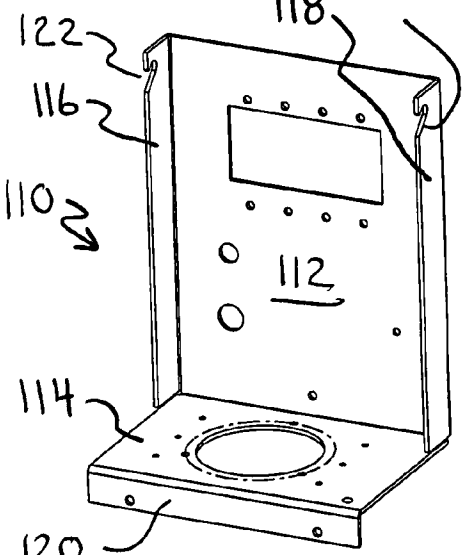
FIG. 21 is a perspective view of the face plate for mounting the electrical components for the surface-mounted transfer switch.
Figure 24:
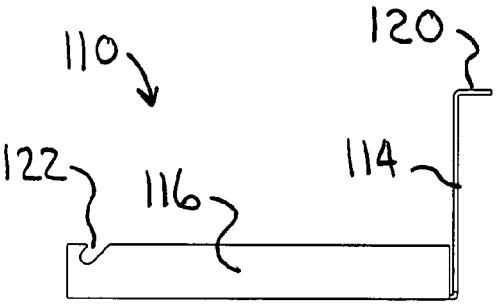
FIG. 24 is a side elevation of the face plate.
Figure 25:
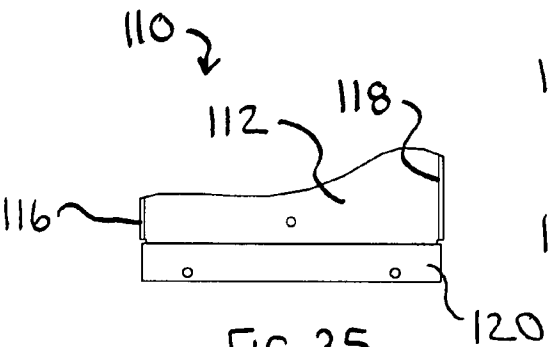
FIG. 25 is a fragmentary rear view of the face plate.
Figure 23:
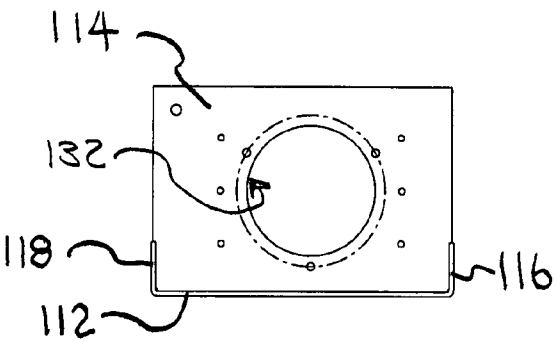
FIG. 23 is a top plan view of the face plate.
Figure 22:
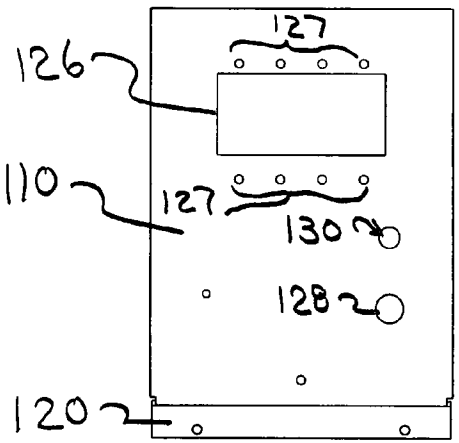
FIG. 22 is a front elevation of the face plate.
Figure 26:
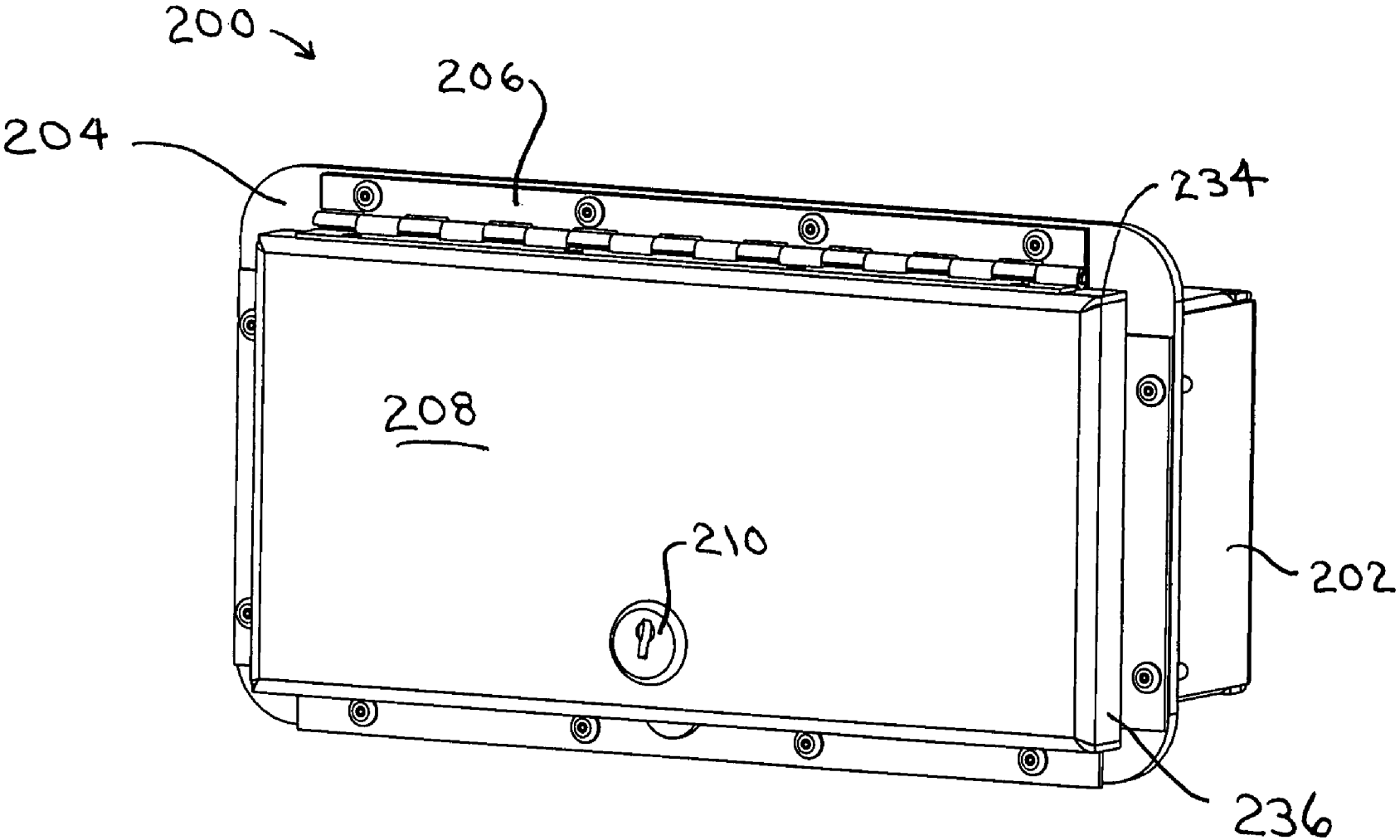
FIG. 26 is a perspective view of a flush-mounted traffic signal transfer switch according to an alternative preferred embodiment of the invention, shown in a closed configuration.
Figure 27:
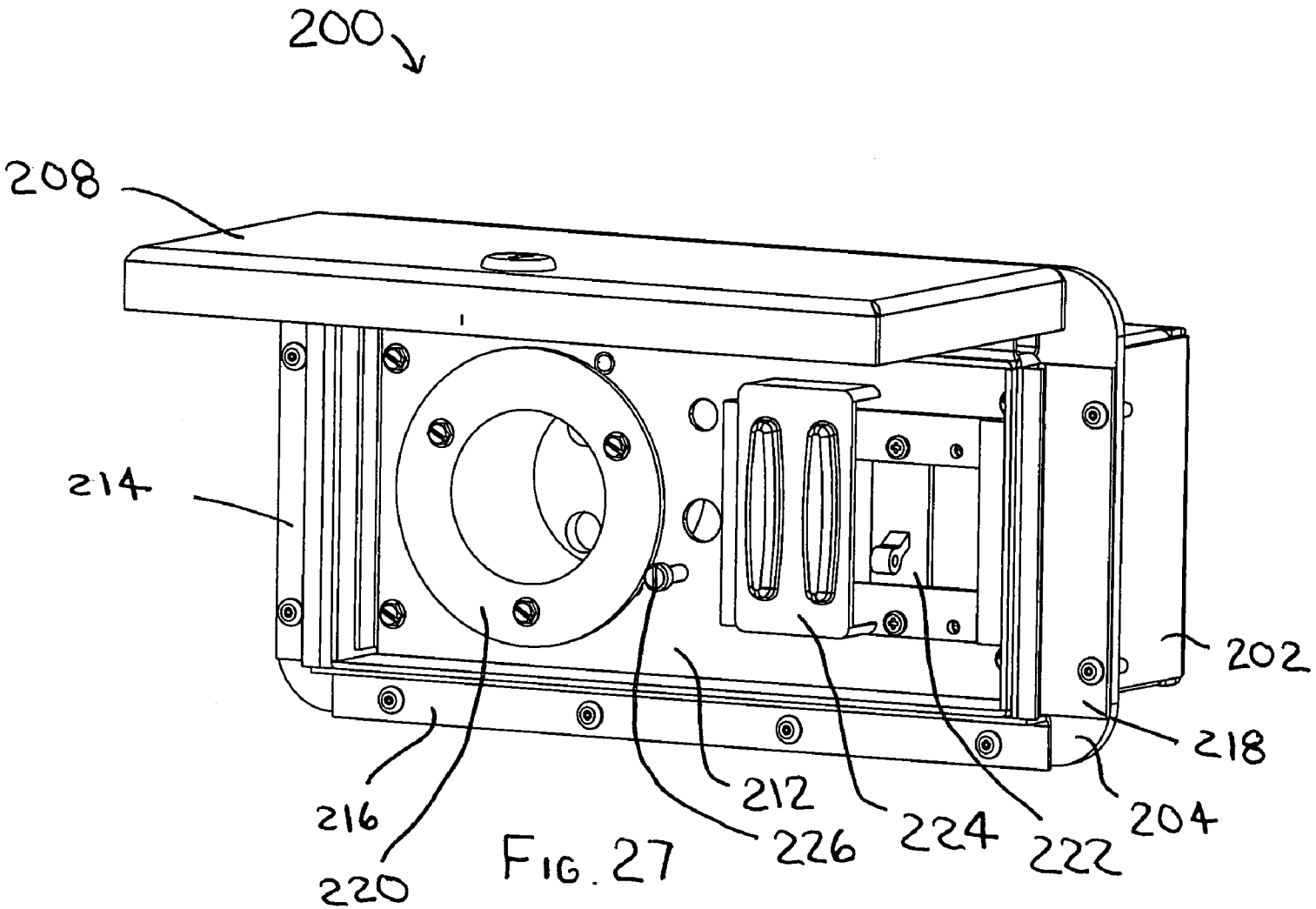
FIG. 27 is a perspective view of the flush-mounted traffic signal transfer switch according to an alternative preferred embodiment of the invention, shown in an open configuration.

FIG. 21 is a perspective view of the faceplate 110, for the surface-mounted transfer switch. FIG. 22 is a front elevation thereof. FIG. 23 is a top plan view thereof. FIG. 24 is a side elevation thereof, and FIG. 25 is a rear fragmentary elevation thereof. Faceplate 110 includes front plate 112, bottom plate 114 for attaching the generator power inlet socket (not shown), side mounting flanges 116, 118, and bottom mounting flange 120. Side mounting flanges 116, 118 include notches 122, 124, which are configured to pivotably engage suitably positioned pins or rivets, extending inwardly from the inside surfaces of sides 54, 56, so that faceplate 110 can hang on and pivot around those pins or rivets, unless and until bottom mounting flange 120 is releasable attached (to permit access for maintenance purposes) to the inside surface of back 58, such as by bolts or machine screws.

Front plate 112 includes aperture 126, suitably dimensioned for from 2-4 circuit breakers to be aligned therewith and affixed, such as by machine screws (through bores 127), as well as apertures 128, 130 for the pilot light and pilot light circuit breaker, as described hereinabove. Bottom plate 114 includes aperture 132, for receiving a generator power inlet socket, to be attached via suitable fasteners into bores surrounding aperture 132, as illustrated.

The surface-mounted transfer switch of the embodiment of FIGS. 6-25 is generally configured to be provided as an "after-market" piece of equipment, to be retro-fitted onto existing traffic signal controllers. To provide a traffic signal transfer switch which is to be integrated into the housing/cabinet of the traffic signal controller (for original installation), as well as to provide for a more streamlined or aesthetic appearance, and as well to provide for a transfer switch construction which is less susceptible to weather as well as tampering or vandalism, a flush-mounted traffic signal transfer switch is provided in the alternative embodiment of the present invention, as shown in FIGS. 26-32. Apart from the structural details of the housing, the electrical components and connections will be the same as in the surface-mounted embodiment of FIGS. 6-25; therefore the electrical schematics of FIGS. 1-5 are applicable to both the surface-mounted and flush-mounted transfer switch configurations.

Figure 29:
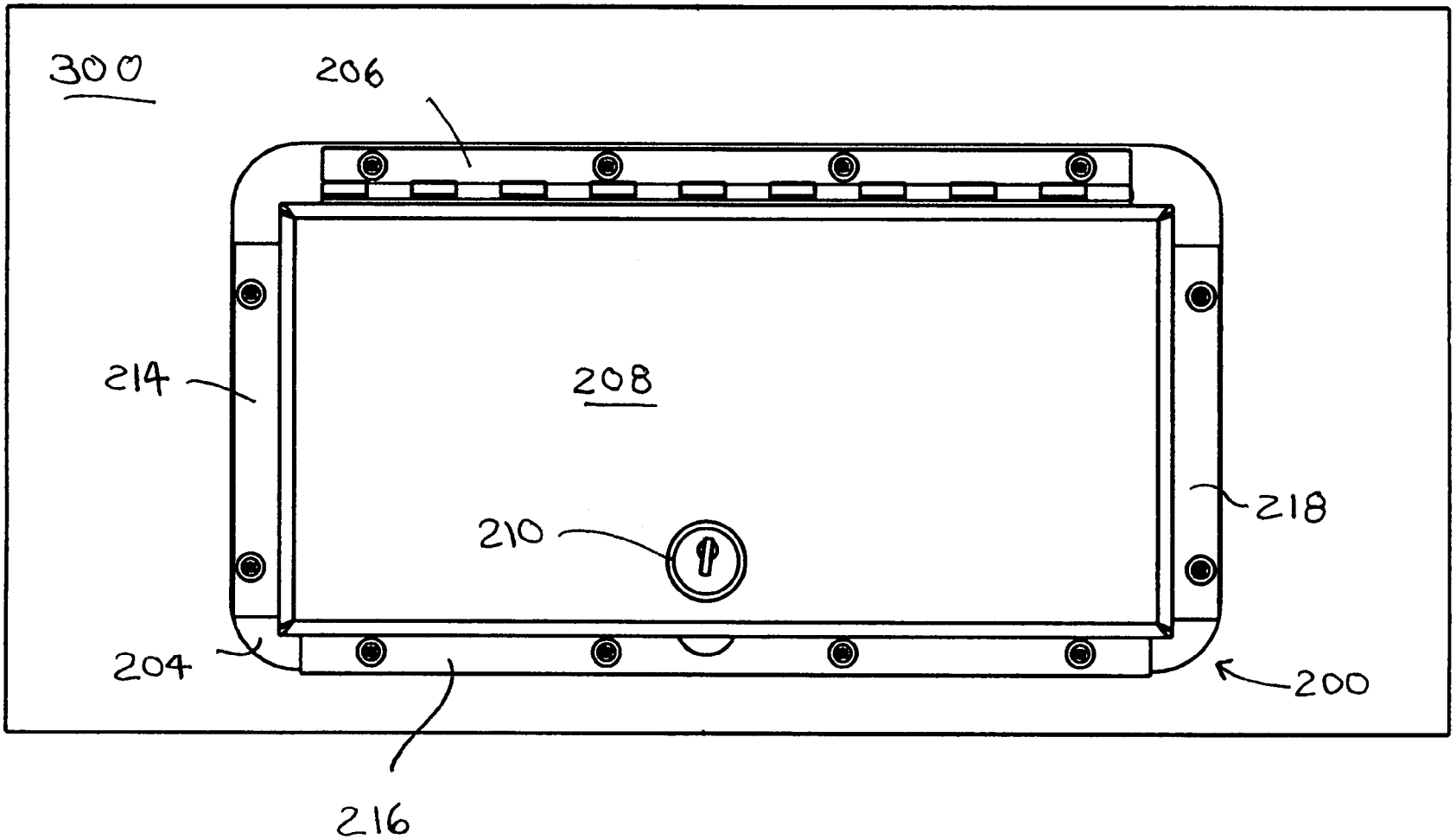
FIG. 29 is a front elevation of the flush-mounted traffic signal transfer switch, shown in closed configuration.
Figure 30:
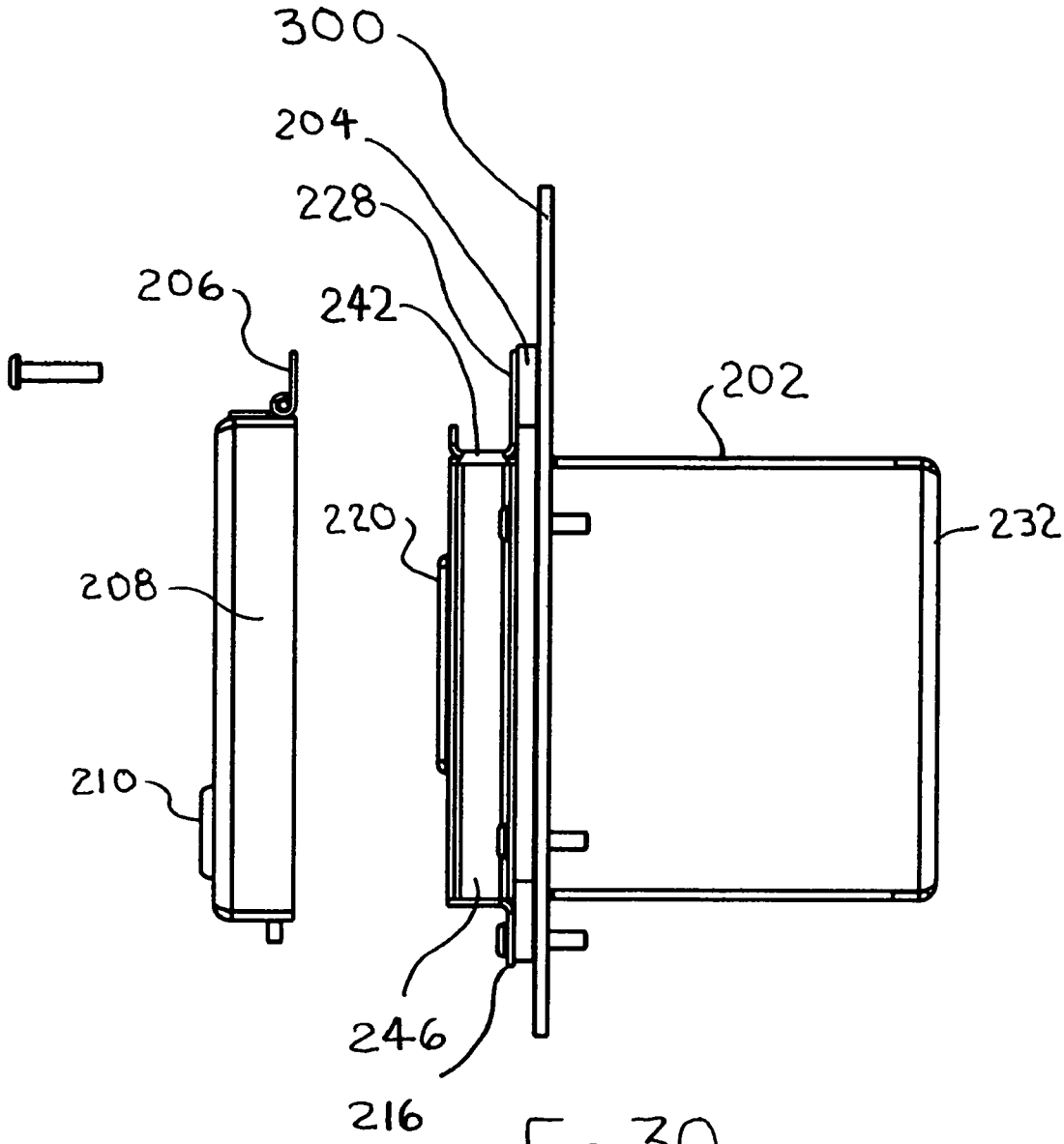
FIG. 30 is a partially exploded side elevation of the flush-mounted traffic signal transfer switch.
Figure 31:
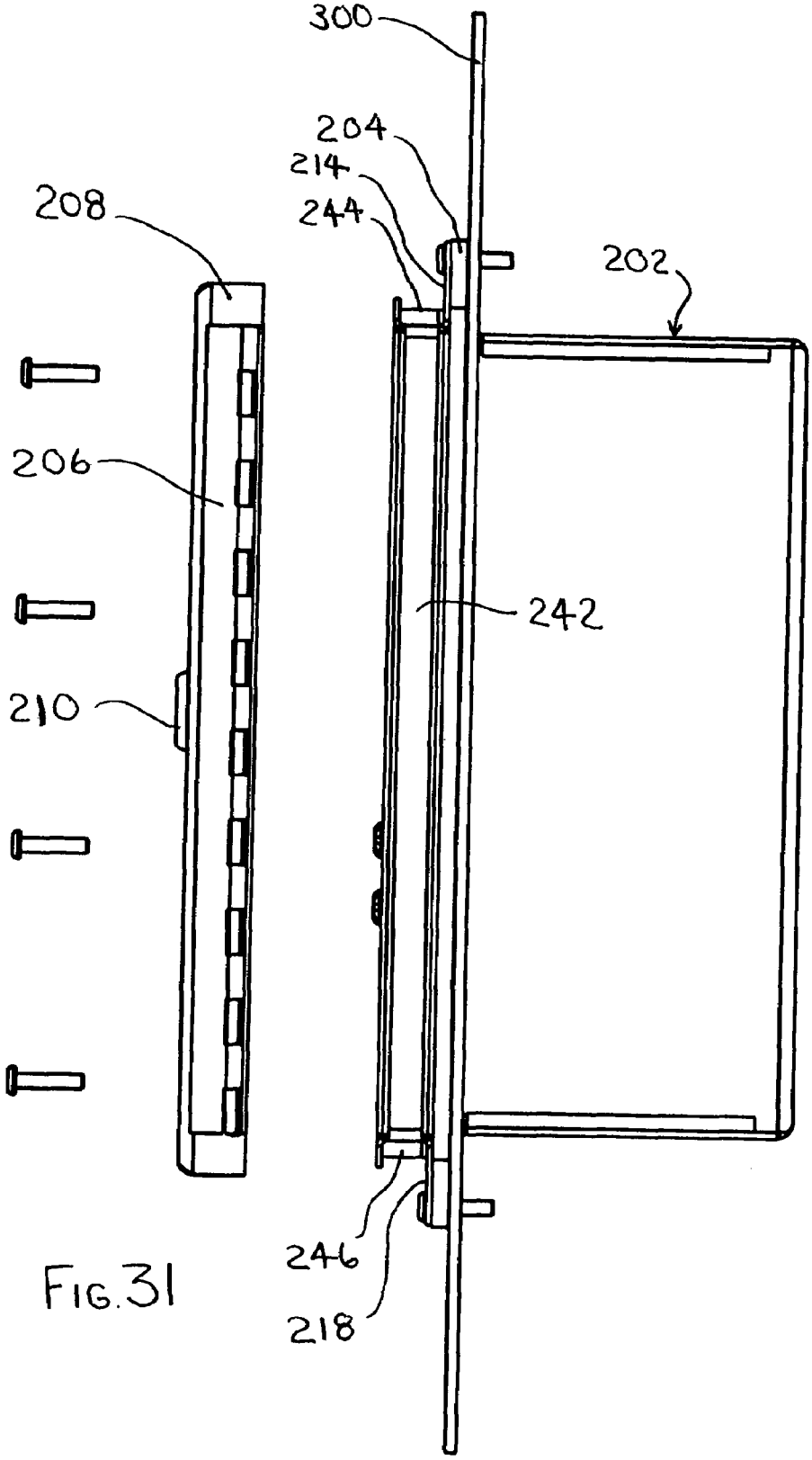
FIG. 31 is a partially exploded top elevation of the flush-mounted traffic signal transfer switch.
Figure 32:
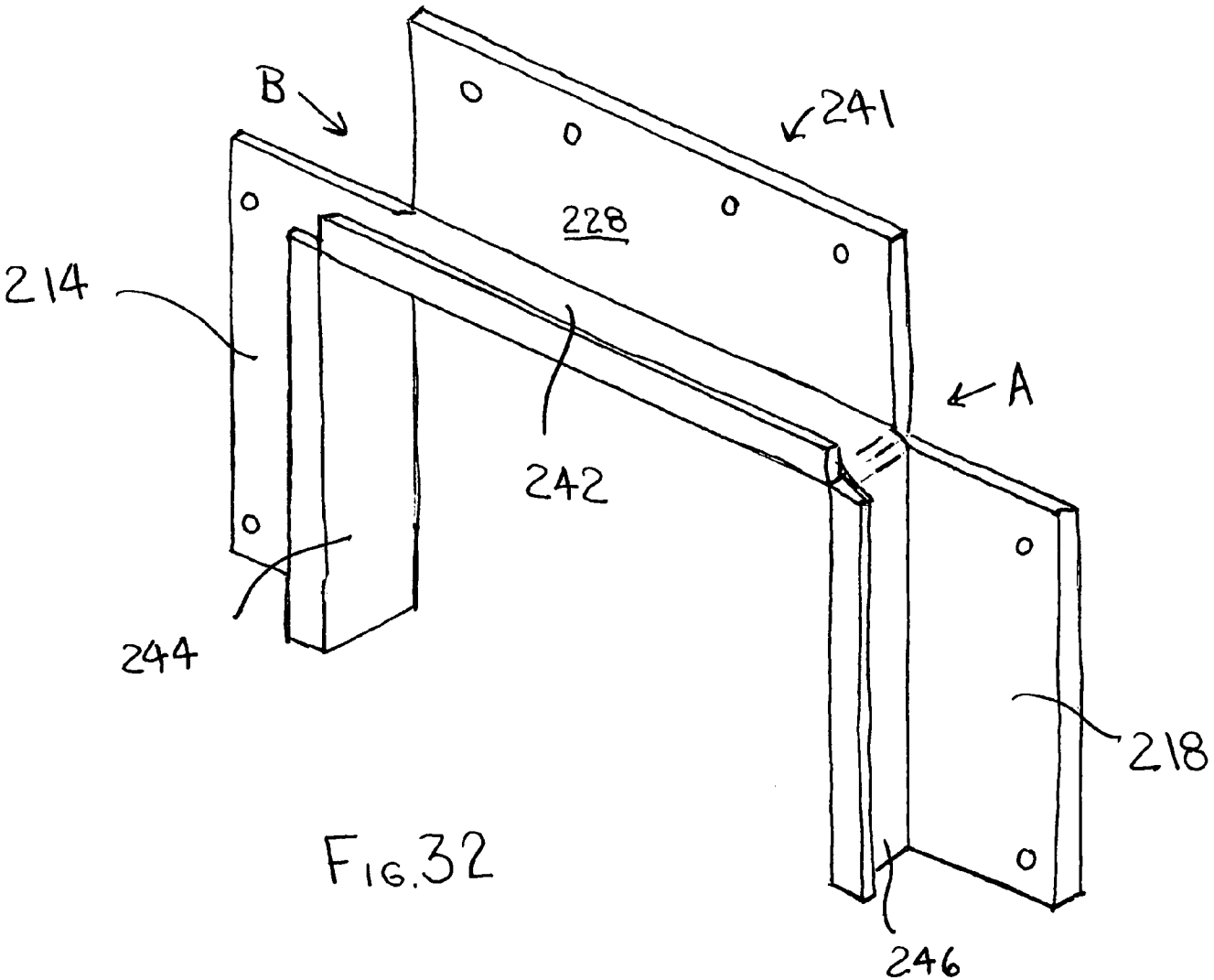
FIG. 32 is a perspective view of the run-off channel structure, for the flush-mounted traffic signal transfer switch.
Figure 33:
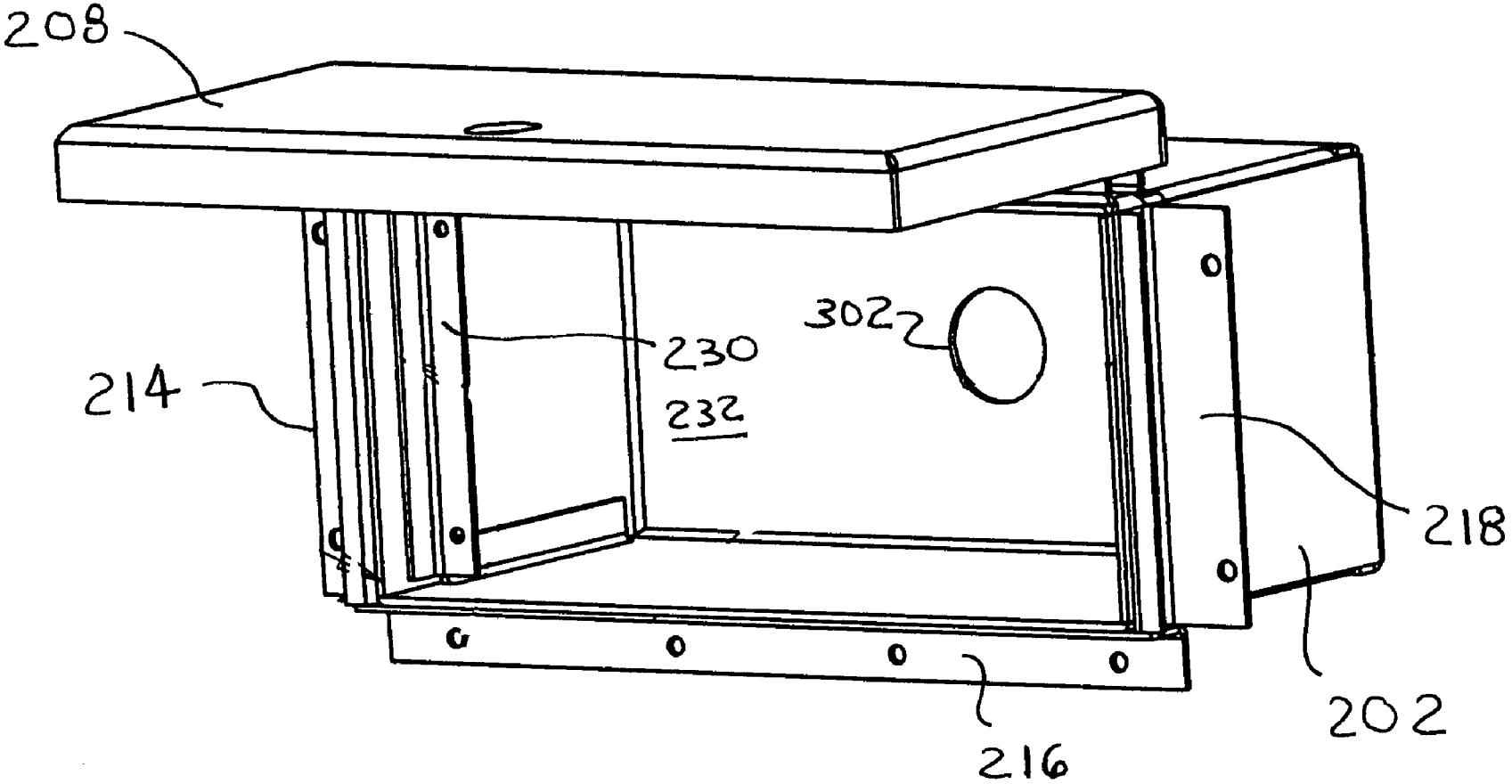
FIG. 33 is a perspective view of the housing and cover for the flush-mounted traffic signal transfer switch, in an open configuration.
Figure 34:
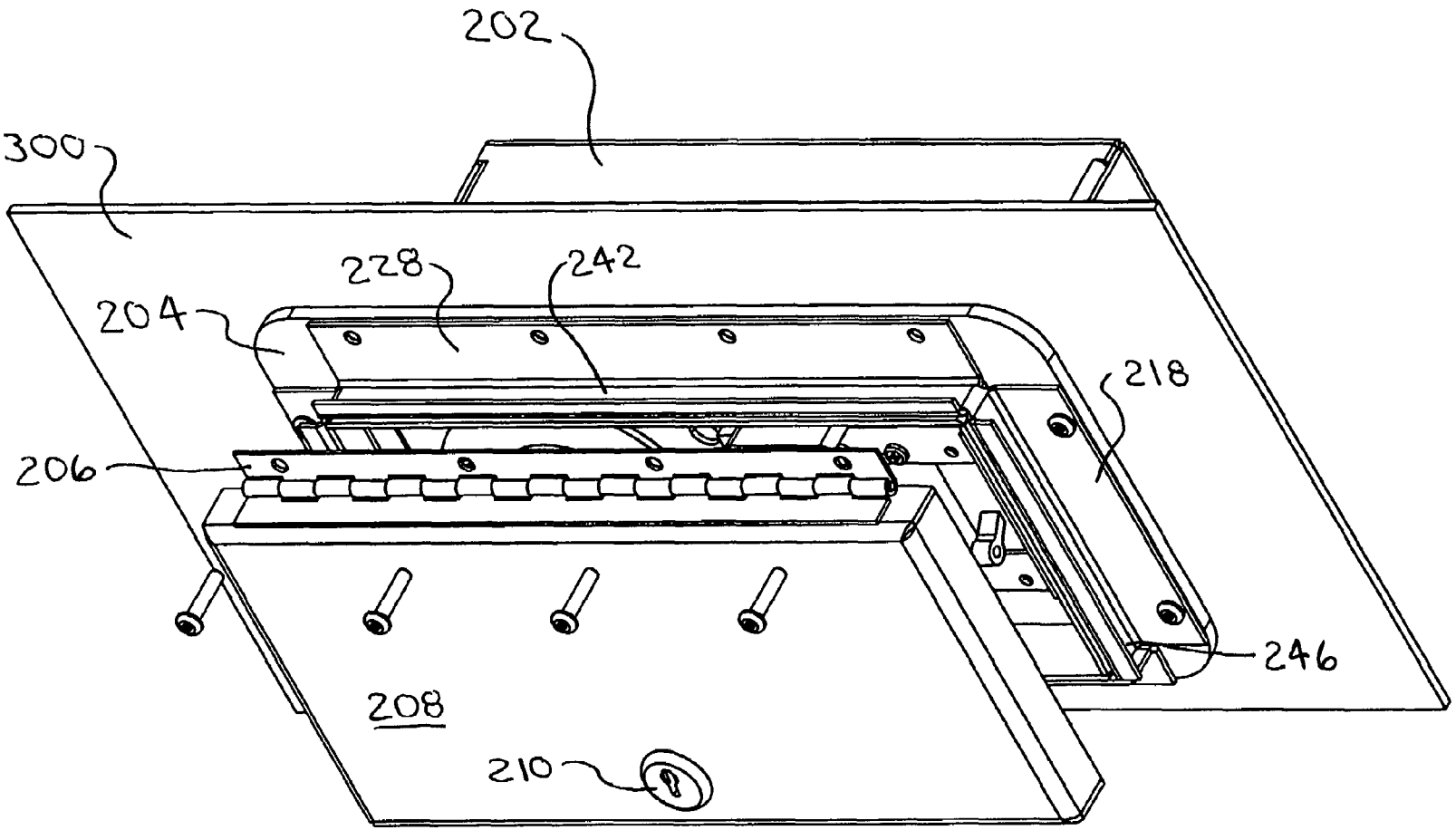
FIG. 34 is a perspective partially exploded view of the flush-mounted traffic signal transfer switch.

Flush-mounted transfer switch 200 is configured to be fitted into an aperture within the cabinet of a traffic signal controller, a portion of the wall 300 of which is shown in FIGS. 29-31, such that the electrical components are within the interior of the traffic signal controller, as well as being surrounded by the housing of the transfer switch itself.

Figure 28:
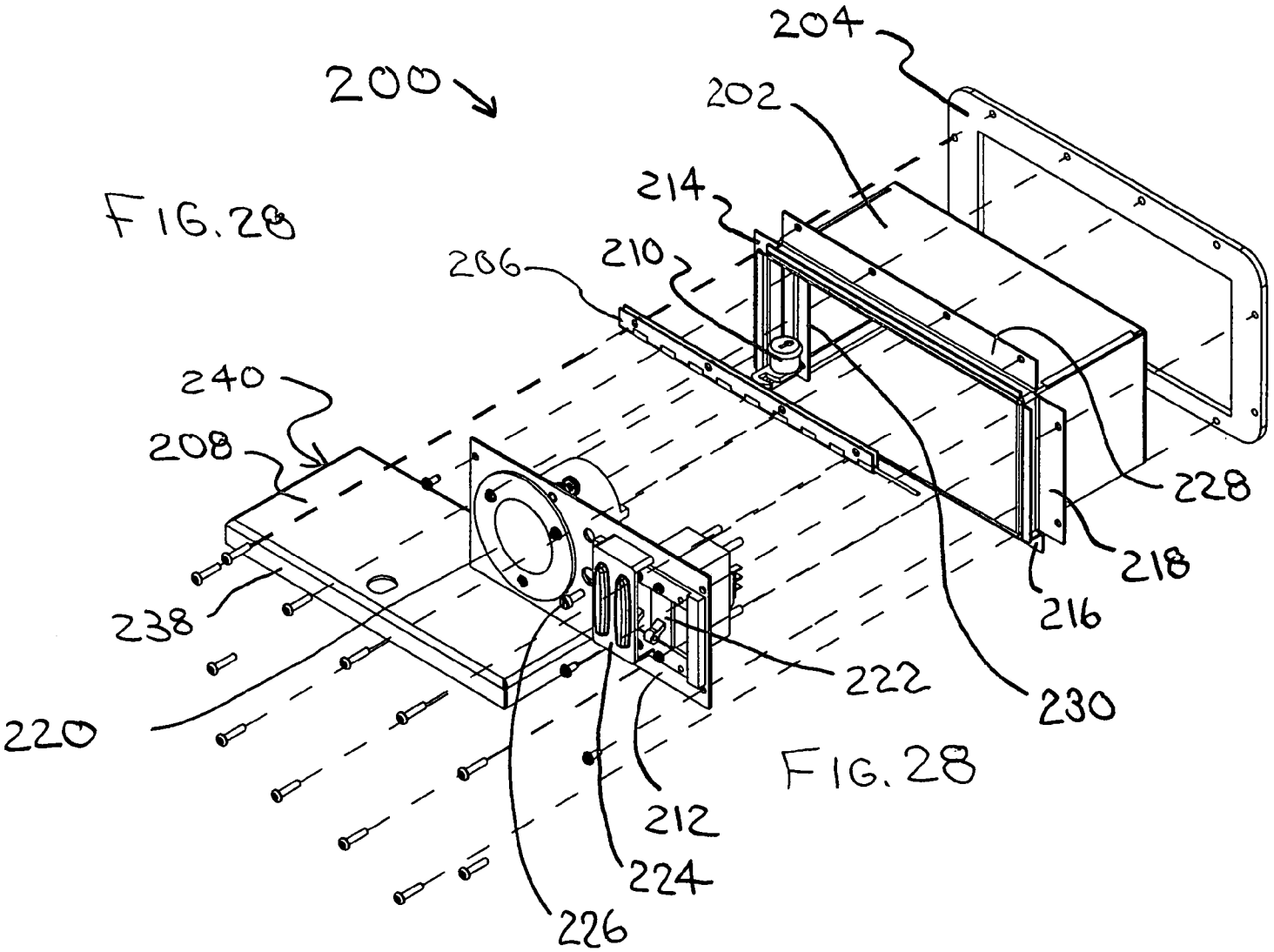
FIG. 28 is an exploded, perspective view of a flush-mounted traffic signal transfer switch according to an alternative preferred embodiment of the invention.

Flush-mounted transfer switch 200 includes housing 202, gasket 204 (for the interface between the traffic signal controller cabinet 300 and housing 202), hinge 206, cover 208, lock 210, face plate 212, housing mounting side flange 214, housing mounting bottom flange 216, housing mounting side flange 218, power inlet power inlet 220, breaker switches 222 covered by lockout mechanism 224, and locking bolt 226. Between one leaf of hinge 206 and rectangular mounting frame 204 is vertically extending housing mounting top flange 228 (shown in FIG. 28). Two face plate mounting flanges 230 (one of which is shown in FIG. 28) extend inwardly from opposing side wall inside surfaces of housing 202, and are provided with suitable fastener apertures (or other means) for mounting face plate 212.

Housing 202 may be fabricated from suitable metal material using any suitable fabrication method, to produce a top wall, a bottom wall, two side walls, and a rear wall, and a front opening. Such a basic structure may be readily formed and fabricated by one of ordinary skill in the art, having the present disclosure before them. Rear wall 232 of housing 202 will have one or more suitably positioned apertures (e.g., aperture 302) or knockouts, to provide required access to make the necessary electrical connections.

The outermost edges of housing 202, extend outwardly beyond flanges 214, 216, 218 and 228. Cover 208 is provided with rearwardly extending flanges 234, 236, 238, 240, which cover the outermost edges of housing 202, to substantially preclude intrusion by water, dust, etc.

To provide transfer switch 200 with the required degree of weatherproof capability, without the need for gaskets, seals or other structures, housing 202 is provided with water run-off channels, extending across the top edge of the opening of housing 202, and down along the side edges of the opening of housing 202, so that should any rainwater or snowmelt get past cover 208, or between hinge 206 and flange 228, it will be directed to the sides and downwardly, and not back under the top edge of the opening, toward the face plate. These run-off channels (e.g., channel 242, FIG. 30) have J-shaped cross-sectional configurations. In a preferred embodiment of the invention (see FIG. 32, not to scale), the horizontally extending run-off channel 242 and vertically extending run-off channels 244, 246 are all originally formed as a single elongated member 241 having a J-shaped cross-section, which is cut at two locations A and B, corresponding to the corners where the top edge of the housing opening meets the side edges of the housing opening, and then bent at those locations. Thus, flanges 214, 228 and 218 are formed integrally with channels 242, 244 and 246. This results in the structure shown in FIG. 32, having rectangular gaps. However, in ordinary usage, these gaps are not believed to enable any significant infiltration of water toward the interior of transfer switch 200. Alternatively, the rectangular gaps may be filled with a sealing structure, such as silver caulk or a bead of welding material appropriate to the metal of the run-off channels, though using a bead of welding material is typically more difficult to maintain in position and fill the gap, compared to a metal caulking material.

The use of the run-off channels is believed to provide for a substantially weatherproof construction, without requiring the use of elastomeric gaskets or seals. Member 241 is then spot welded to the outside of housing 202. As a J-shaped channel is not believed required for the bottom of housing 202, flange 216 may simply be provided by a straight length of L-shaped material that is welded along the outside of the bottom wall of housing 202. Alternatively, a J-shaped section may be employed if desired.

The foregoing description and drawings merely explain and illustrate the invention, and the invention is not so limited as those skilled in the art who have the disclosure before them will be able to make modifications and variations therein without departing from the scope of the invention.

What is claimed is:

1. A transfer switch, operably configured to be connected to a portable electrical power generator, a traffic signal controller and a utility electrical power source, for enabling repeated switching between the portable electrical power generator and the utility electrical power source to provide electrical power to the traffic signal controller, comprising:

a housing, having a cavity therewithin and at least a first opening thereto;

transfer switch circuitry disposed in the cavity in the housing, the transfer switch circuitry including a power inlet for receiving the power outlet connector of a portable electrical power generator, a switching mechanism for reciprocably switching between at least a first position, enabling power to be supplied from the portable electrical power generator to the traffic signal controller, and a second position, enabling power to be supplied from the utility electrical power source to the traffic signal controller, a first electrical input connection, associated with the switching mechanism, and operably configured to be connected to a utility line power supply, a second electrical input connection, associated with the switching mechanism, and operably connected to the power inlet, and at least one electrical output connection, associated with the switching mechanism, and operably configured to be connected to a traffic signal controller;

a lockout device, operably associated with the switching mechanism, for preventing the switching mechanism from being positioned so as to enable power from both the portable electrical power generator and the utility electrical power source from being supplied to the traffic signal controller.

2. The traffic signal transfer switch according to claim 1, wherein the housing further comprises:

at least one pivotable cover for protecting the cavity from intrusion by undesired materials.

3. The traffic signal transfer switch according to claim 1, wherein the housing is operably configured to be mounted to an exterior surface of a cabinet of a traffic signal controller.

4. The traffic signal transfer switch according to claim 1, further comprising:

a face plate, disposed in the at least first opening, for enclosing transfer switch circuitry within the housing.

5. The traffic signal transfer switch according to claim 1, wherein the housing comprises:

opposed side walls having front edges, bottom edges, and top edges and a rear wall having a top edge; and a top having downwardly extending flanges covering the top edges of the side walls and rear wall, and a further downwardly extending flange extending across a front opening of the housing.

6. The traffic signal transfer switch according to claim 5, wherein the at least one pivotable cover comprises:

a bottom cover, pivotably mounted to the opposed side walls between at least an open position and a closed position, and having a bottom panel and two side flanges extending upwardly when the bottom cover is in its closed position, the two side flanges being disposed to the inside of the bottom edges of the side walls, when the bottom cover is in its closed position; and a front cover, pivotably mounted to the opposed side walls between at least an open position and a closed position, the front cover further having a front panel, two side flanges and a bottom flange, which extend rearwardly from the front panel when the front panel is in its closed position, the side flanges covering the front edges of the opposed side walls when the front cover is in its closed position, and the bottom flange covering a front edge of the bottom cover, when the front cover and the bottom cover are in their respective closed positions.

7. The traffic signal transfer switch according to claim 1, wherein the switching mechanism comprises:

at least a first circuit breaker electrically connected between the first electrical input connection and the at least one electrical output connection; and at least a second circuit breaker electrically connected between the second electrical input connection and the at least one electrical output connection.

8. The traffic signal transfer switch according to claim 1, further comprising:

an indicator, operably connected to the switching mechanism, and operably configured to provide an indication when utility line power is available.

9. The traffic signal transfer switch according to claim 7, further comprising:

an indicator, operably connected to the at least first circuit breaker, to indicate when utility line power is available.

10. The traffic signal transfer switch according to claim 9, wherein the indicator is a light.

11. The traffic signal transfer switch according to claim 1, wherein the housing is operably configured to be mounted within a suitably configured recess in a cabinet for a traffic signal controller.

12. The traffic signal transfer switch according to claim 1, wherein the housing comprises:

a top wall, a bottom wall, two opposed side walls and a rear wall, and a front opening.

13. The traffic signal transfer switch according to claim 12, wherein the housing further comprises:

at least one mounting flange emanating away from at least one of the top wall, bottom wall, two opposed side walls, and operably configured for attachment to a mounting frame, which, in turn, is operably configured for attachment to an outer wall of a traffic signal controller.

14. The traffic signal transfer switch according to claim 12, wherein the housing further comprises:

a plurality of run-off channels extending along the top wall, and two opposed side walls, between the front opening and the at least one mounting flange.

15. The traffic signal transfer switch according to claim 14, wherein each of the run-off channels has a J-shaped cross-sectional configuration.

16. The traffic signal transfer switch according to claim 14, wherein the at least one pivotable cover comprises:

a front cover panel, hingedly mounted to the at least one mounting flange, the front cover panel being pivotable between at least a first, upward open position, and a second, downward closed position; and a plurality of side flanges emanating rearwardly from at least top and side edges of the front cover panel, when the front cover panel is in its second, downward closed position, the side flanges being configured to extend over the run-off channels, when the front cover panel is in its closed position.

17. The traffic signal transfer switch according to claim 1, wherein the switching mechanism comprises:

two first circuit breakers electrically connected between the first electrical input connection and the at least one electrical output connection; and two second circuit breakers electrically connected between the second electrical input connection and the at least one electrical output connection.

18. The traffic signal transfer switch according to claim 1, wherein the transfer switch circuitry further comprises:

a first electrical neutral connection, associated with the switching mechanism, and operably configured to be connected to a neutral connection of a utility line power supply;

a second electrical neutral connection, associated with the switching mechanism, and operably configured to be connected to a neutral connection of the power inlet;

a third electrical neutral connection, associated with the switching mechanism and operably configured to be connected to a neutral electrical connection of a traffic signal controller.

19. The traffic signal transfer switch according to claim 18, wherein the switching mechanism further comprises:

a first neutral circuit breaker, connected to the first electrical neutral connection and the third electrical neutral connection; and a second neutral circuit breaker, connected to the second electrical neutral connection and the third electrical neutral connection.

* * * * *